US010649391B2

(12) United States Patent
Tamaki et al.

(10) Patent No.: US 10,649,391 B2
(45) Date of Patent: May 12, 2020

(54) IMAGE FORMING APPARATUS

(71) Applicant: CANON KABUSHIKI KAISHA, Tokyo (JP)

(72) Inventors: Masayuki Tamaki, Kashiwa (JP); Shigeaki Takada, Abiko (JP); Daigo Matsuura, Tokyo (JP); Yasuharu Chiyoda, Nagareyama (JP); Masahiro Tsujibayashi, Nagareyama (JP); Kengo Koyama, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/542,387

(22) Filed: Aug. 16, 2019

(65) Prior Publication Data

US 2020/0073314 A1 Mar. 5, 2020

(30) Foreign Application Priority Data

Sep. 4, 2018 (JP) ..... 2018-165480
Apr. 18, 2019 (JP) ..... 2019-079662

(51) Int. Cl.
*G03G 21/00* (2006.01)
*G03G 15/20* (2006.01)
(Continued)

(52) U.S. Cl.
CPC ..... *G03G 21/0041* (2013.01); *G03G 15/1605* (2013.01); *G03G 15/2025* (2013.01);
(Continued)

(58) Field of Classification Search
CPC .. G03G 15/161; G03G 15/166; G03G 15/168; G03G 15/1605; G03G 15/2025;
(Continued)

(56) References Cited

U.S. PATENT DOCUMENTS 5,850,588 A * 12/1998 Yoshikawa ..... G03G 15/2025 399/327
6,665,513 B2 * 12/2003 Katoh ..... G03G 15/2025 399/327
(Continued)

FOREIGN PATENT DOCUMENTS

JP 2007-240569 A 9/2007
JP 2015-148713 A 8/2015

*Primary Examiner* — Hoan H Tran
(74) *Attorney, Agent, or Firm* — Venable LLP

(57) ABSTRACT

An image forming apparatus includes a rotary member, a web, a moving unit, a detecting unit configured to detect a predetermined position, and a control portion. The control portion informs, in a case where an actual moving amount per one winding operation is a first moving amount, the replacement of the web, if a number of sheets of recording materials on which images have been formed after the predetermined position is detected reaches a first number of sheets. The control portion informs, in a case where the actual moving amount per one winding operation is a second moving amount which is greater than the first moving amount, the replacement of the web, if a number of sheets of recording materials on which images have been formed after the predetermined position is detected reaches a second number of sheets which is less than the first number of sheets.

16 Claims, 14 Drawing Sheets

(51) Int. Cl.
*G03G 15/16* (2006.01)
*G03G 15/00* (2006.01)

(52) U.S. Cl.
CPC ..... *G03G 15/2064* (2013.01); *G03G 15/5016* (2013.01); *G03G 2221/0005* (2013.01)

(58) Field of Classification Search
CPC ..... G03G 15/2064; G03G 15/5016; G03G 21/0041; G03G 2215/00455; G03G 2221/0005
USPC ..... 399/122, 123, 264, 320, 327, 343, 352
See application file for complete search history.

(56) References Cited

U.S. PATENT DOCUMENTS

| | | | | |
|---|---|---|---|---|
| 7,715,773 | B2 | 5/2010 | Ide et al. | |
| 7,962,081 | B2 * | 6/2011 | Russel | G03G 15/2025 399/325 |
| 7,979,014 | B2 * | 7/2011 | Achten | G03G 15/2025 399/325 |
| 8,811,870 | B2 * | 8/2014 | Mitsuhashi | G03G 15/2025 399/327 |
| 8,886,097 | B2 * | 11/2014 | Nagata | G03G 15/2025 399/327 |
| 9,235,186 | B2 | 1/2016 | Hatazaki | |
| 2007/0258739 | A1 | 11/2007 | Ide et al. | |
| 2015/0220045 | A1 | 8/2015 | Hatazaki | |

* cited by examiner

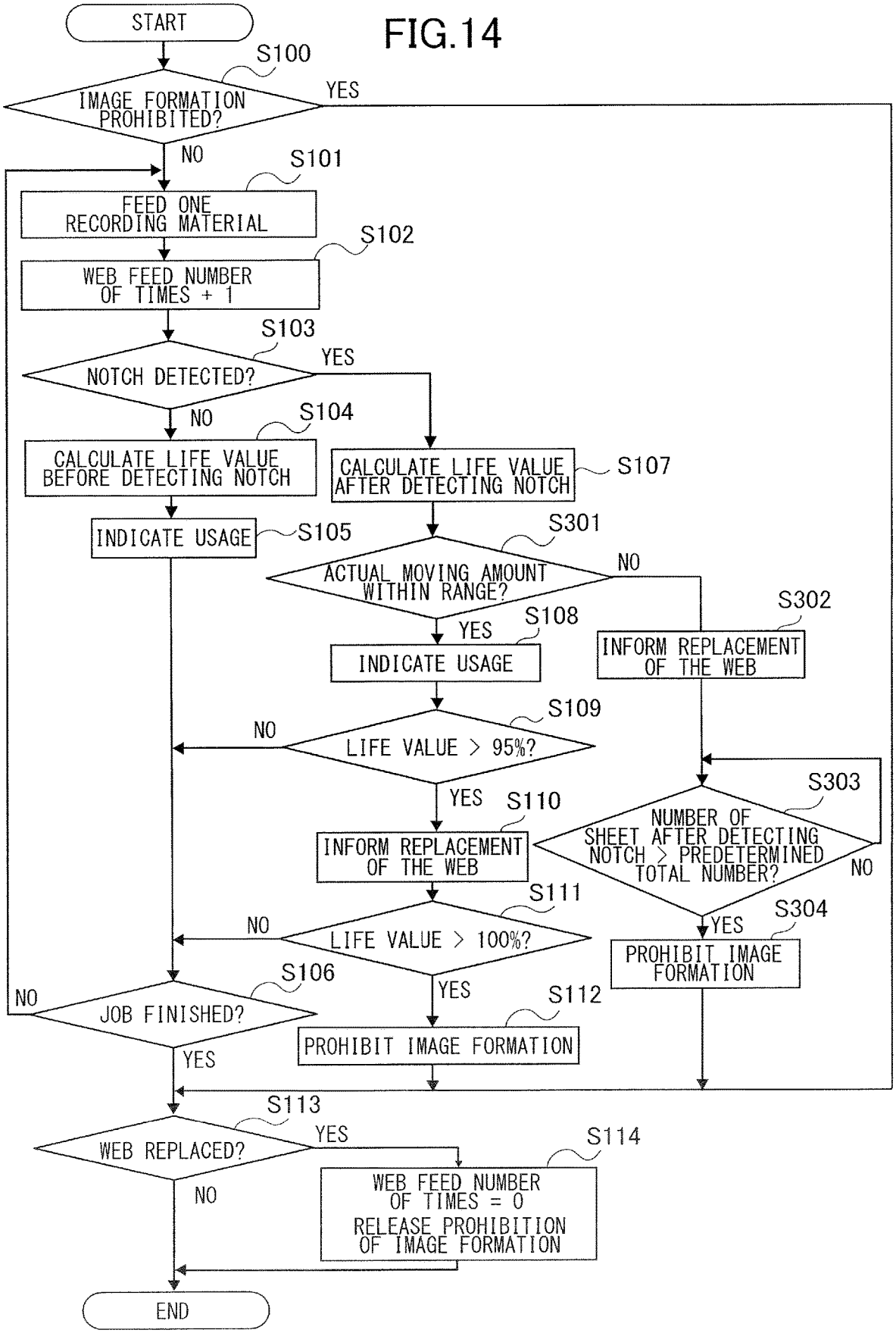
FIG.14
START
S100
IMAGE FORMATION PROHIBITED?
YES
NO
S101
FEED ONE RECORDING MATERIAL
S102
WEB FEED NUMBER OF TIMES + 1
S103
NOTCH DETECTED?
YES
NO
S104
CALCULATE LIFE VALUE BEFORE DETECTING NOTCH
CALCULATE LIFE VALUE AFTER DETECTING NOTCH
S107
INDICATE USAGE
S105
S301
ACTUAL MOVING AMOUNT WITHIN RANGE?
NO
YES
S108
INDICATE USAGE
S302
INFORM REPLACEMENT OF THE WEB
S109
NO
LIFE VALUE > 95%?
YES
S110
INFORM REPLACEMENT OF THE WEB
S303
NUMBER OF SHEET AFTER DETECTING NOTCH > PREDETERMINED TOTAL NUMBER?
NO
YES
S304
PROHIBIT IMAGE FORMATION
S111
NO
LIFE VALUE > 100%?
YES
S106
NO
JOB FINISHED?
YES
S112
PROHIBIT IMAGE FORMATION
S113
WEB REPLACED?
YES
NO
S114
WEB FEED NUMBER OF TIMES = 0
RELEASE PROHIBITION OF IMAGE FORMATION
END

IMAGE FORMING APPARATUS

BACKGROUND OF THE INVENTION

Field of the Invention

The present invention relates to an electro-photographic image forming apparatus provided with a cleaning unit for removing toner adhering to a rotary member by a cleaning web.

Description of the Related Art

An electro-photographic image forming apparatus is provided with a fixing unit to fix a toner image, which has been formed on a recording material such as a sheet of paper, to the recording material by heating and pressurizing the toner image. The fixing unit fixes the toner image by nipping and conveying the recording material by a fixing roller, heated by a heater or the like, and a pressure roller in pressure contact with the fixing roller. If toner adheres to the fixing roller or the pressure roller at this time and the toner is kept adhering to the roller, there is a possibility that the recording material is soiled by the toner. Then, the image forming apparatus is provided with a cleaning unit to remove the toner adhering to the roller. Some of the cleaning unit use a cleaning web (referred to simply as a "web" hereinafter) to remove the toner. In this case, a part of the web that has been used to wipe the toner is difficult to wipe toner again. Therefore, the web is wound up such that another part not used yet is used anew to wipe the toner as disclosed in Japanese Patent Application Laid-open Publication No. 2015-148713 for example. The cleaning unit having the web may be used also to remove toner on an inter mediate transfer belt.

The abovementioned cleaning unit is configured to be able to replace the web and to detect a notch defined on the web by a sensor to inform a user of the replacement of the web. The notch is defined at a position enabling to inform the user of a message to replace the web at an early timing before the web is wound up and is put into a condition of being used up. This arrangement is made not to stop the image forming apparatus immediately even after detecting the notch by the sensor but to be able to form images on a predetermined number of recording materials, e.g., on a limited number of 100 sheets. Then, because it is difficult to remove the toner by the web if the web is in a condition of being used up, an image forming process is prohibited until when the web is replaced with a new web.

However, because a moving amount per one winding operation of the web is different depending on each individual cleaning unit, some cleaning units are put into a condition of being used up before forming images on a predetermined number of recording materials after detecting the notch. Because the image forming process is prohibited until when the web is replaced with a new web in this case, a downtime of the image forming apparatus is extended and it is difficult to efficiently operate the image forming apparatus. Meanwhile, some cleaning units reach to the predetermined number of recording materials before the web is put into the condition of being used up, and the web is forced to be replaced even though the web has much a non-used part and is usable.

SUMMARY OF THE INVENTION

According to a first aspect of the present invention, an image forming apparatus, includes a rotary member, a web in contact with the rotary member to remove toner on the rotary member, a moving unit replaceably supporting the web and configured to wind up the web to move a contact position of the web with the rotary member, the moving unit winding up the web every time when toner images are formed on a unit number of recording materials, if the toner images are formed on the recording materials each having a predetermined size, a detecting unit configured to detect that the web has been wound up to a predetermined position, and a control portion configured to inform a replacement of the web. The control portion informs, in a case where an actual moving amount per one winding operation is a first moving amount, the replacement of the web, if a number of sheets of recording materials on which images have been formed after the predetermined position is detected reaches a first number of sheets, the actual moving amount per one winding operation being defined as an average wind-up amount per unit number of sheets by which the moving unit has wound up the web to the predetermined position. The control portion informs, in a case where the actual moving amount per one winding operation is a second moving amount which is greater than the first moving amount, the replacement of the web, if a number of sheets of recording materials on which images have been formed after the predetermined position is detected reaches a second number of sheets which is less than the first number of sheets.

According to a second aspect of the present invention, an image forming apparatus includes a rotary member, a web in contact with the rotary member to remove toner on the rotary member, a display portion indicating a usage of the web, a moving unit replaceably supporting the web and configured to wind up the web to move a contact position of the web with the rotary member, the moving unit winding up the web every time when toner images are formed on a unit number of recording materials, if the toner images are formed on the recording materials each having the recording materials of a predetermined size, a detecting unit configured to detect that the web has been wound up to a predetermined position, and a control portion configured to indicate an usage of the web in the display portion. The control portion indicates a first usage obtained by a number of times by which the web is wound by driving the moving unit and a unit wind-up amount of the web per one winding operation set in advance, until the predetermined position is detected. The control portion indicates a second usage obtained by a number of times by which the web has been wound and an actual moving amount per one winding operation after the predetermined position is detected, the actual moving amount per one winding operation being defined as an average wind-up amount per unit number of sheets by which the moving unit has wound up the web to the predetermined position.

According to a third aspect of the present invention, An image forming apparatus includes a rotary member, a web in contact with the rotary member to remove toner on the rotary member, a moving unit replaceably supporting the web and configured to wind up the web to move a contact position of the web with the rotary member, the moving unit winding up the web every time when toner images are formed on a unit number of recording materials, if the toner images are formed on the recording materials each having a predetermined size, a detecting unit configured to detect that the web has been wound up to a predetermined position, and a control portion configured to inform a replacement of the web if an actual moving amount per one wind-up amount defined as an average wind-up amount per unit number of sheets by which the moving unit has wound up the web to the predetermined position is not within a wind-up range of the web per one winding operation set in advance.

According to a forth aspect of the present invention, an image forming apparatus includes a rotary member, a web in contact with the rotary member to remove toner on the rotary member, a moving unit replaceably supporting the web and configured to wind up the web to move a contact position of the web with the rotary member, a detecting unit configured to detect that the web has been wound up to a predetermined position, a control portion to which a unit wind-up amount of the web per unit rotation amount of the rotary member is set and which is configured to move the web by the moving unit corresponding to a rotation amount of the rotary member, a storage portion configured to store the rotation amount of the rotary member. In response to a detection of the predetermined position by the detecting unit, the control portion obtains an actual moving amount of the web per unit rotation amount from a rotation amount, stored in the storage portion, of the rotary member until the predetermined position is detected and a length of the web to the predetermined position, and informs a replacement of the web based on the actual moving amount and a remaining length of the web.

Further features of the present invention will become apparent from the following description of exemplary embodiments with reference to the attached drawings.

BRIEF DESCRIPTION OF THE DRAWINGS

FIG. 14 is a flowchart indicating a replacement informing process of a third embodiment.

DESCRIPTION OF THE EMBODIMENTS

First Embodiment

Image Forming Apparatus

Figure 1:
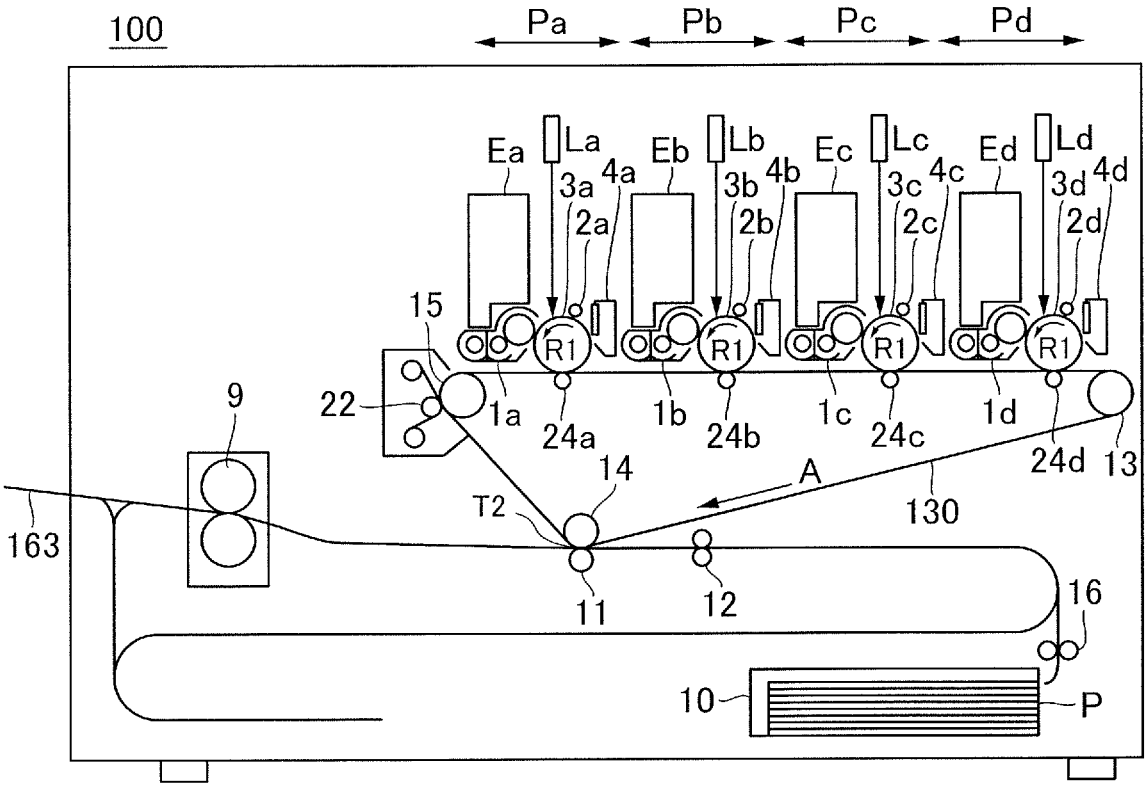
FIG. 1 is a schematic diagram illustrating a configuration of an image forming apparatus of a present embodiment.

An outline of a configuration of an image forming apparatus of the present embodiment will be described with reference to FIG. 1. The image forming apparatus 100 as illustrated in FIG. 1 is a tandem intermediate transfer type full color printer in which image forming units Pa, Pb, Pc and Pd of yellow, magenta, cyan and black colors are disposed respectively along an intermediate transfer belt 130 that rotationally moves.

A yellow toner image is formed on a photosensitive drum 3*a* and is transferred onto the intermediate transfer belt 130 in the image forming unit Pa. A magenta toner image is formed on a photosensitive drum 3*b* and is transferred onto the intermediate transfer belt 130 in the image forming unit Pa. In the same manner, cyan and black toner images are formed on photosensitive drums 3*c* and 3*d* and are transferred onto the intermediate transfer belt 130 respectively in the image forming units Pc and Pd. The four color toner images transferred onto the intermediate transfer belt 130 serving as an image bearing member are conveyed to a secondary transfer portion T2 to be secondarily transferred onto a recording material P such as a sheet of paper and a sheet material such as an OHP sheet. A separation roller 16 separates the recording material P delivered out of a cassette 10 one by one to send to a registration roller 12. The registration roller 12 transfers the recording material P to the secondary transfer portion T2 by synchronizing with the toner image on the intermediate transfer belt 130. The recording material P onto which the four color toner images have been secondarily transferred is heated and pressurized in a fixing unit 9 to fix the toner image on a surface of the recording material P.

In a case of simplex printing, the recording material P onto which the toner image has been fixed by the fixing unit 9 is straightly discharged to a discharge tray 163. In a case of duplex printing, the recording material P in which the toner image has been transferred onto a first surface thereof is reversed and is guided to a reverse conveyance path to be then fed again to the registration roller 12. Then, the recording material P in which a toner image has been transferred onto a second surface thereof at the secondary transfer portion T2 is fixed by the fixing unit 9 and is then discharged to the discharge tray 163.

Image Forming Unit

The four image forming units Pa, Pb, Pc and Pd provided in the image forming apparatus 100 are constructed substantially in the same manner except of that the colors of toners used in the developing units 1*a*, 1*b*, 1*c* and 1*d* differ as yellow, magenta, cyan and black colors. Then, the image forming unit Pa of yellow color will be typically exemplified below and description of the other image forming units Pb, Pc and Pd will be omitted here.

The image forming unit Pa includes a charging unit 2*a*, an exposing unit La, a developing unit 1*a*, a transfer roller 24*a* and a drum cleaning unit 4*a* around a photosensitive drum 3*a*. The photosensitive drum 3*a* is an electro-photographic photosensitive member in which a photosensitive layer is formed on an outer circumferential surface of an aluminum-made cylinder for example and turns in a direction of an arrow R1 in FIG. 1 with a predetermined process speed.

The charging unit 2*a* homogeneously charges the surface of the photosensitive drum 3*a* with predetermined polarity and potential. The exposing unit La scans the photosensitive drum 3*a* with a laser beam of a scan line image signal developing an image of each color and ON-OFF modulated by a rotation mirror not illustrated to form an electrostatic latent image on the photosensitive drum 3*a*. The developing unit 1*a* develops the electrostatic latent image formed on the photosensitive drum 3*a* into a toner image by using a developing agent. A replenishing unit Ea replenishes an amount of toner corresponding to an amount of toner consumed by the development to the developing unit 1*a*.

The transfer roller 24*a* presses the intermediate transfer belt 130 to form a primary transfer portion between the photosensitive drum 3*a* and the intermediate transfer belt 130. By applying a predetermined voltage to the transfer roller 24*a*, the toner image on the photosensitive drum 3*a* is primarily transferred onto the intermediate transfer belt 130.

The intermediate transfer belt 130 is wrapped around a tension roller 15, a secondary transfer inner roller 14 and a driving roller 13 and rotates in a direction of an arrow A in FIG. 1 by being driven by the driving roller 13. A secondary transfer outer roller 11 is in contact with the intermediate transfer belt 130 and forms the secondary transfer portion T2. By applying a predetermined voltage to the secondary transfer outer roller 11, the toner image on the intermediate transfer belt 130 is secondarily transferred onto the recording material P passing through the secondary transfer portion T2.

The drum cleaning unit 4*a* collects the toner left on the photosensitive drum 3*a* after the primary transfer by causing a cleaning blade to frictionally slide with the photosensitive drum 3*a*. A belt cleaning unit 22 collects the toner left on the intermediate transfer belt 130 after the secondary transfer.

Fixing Unit

Figure 2:
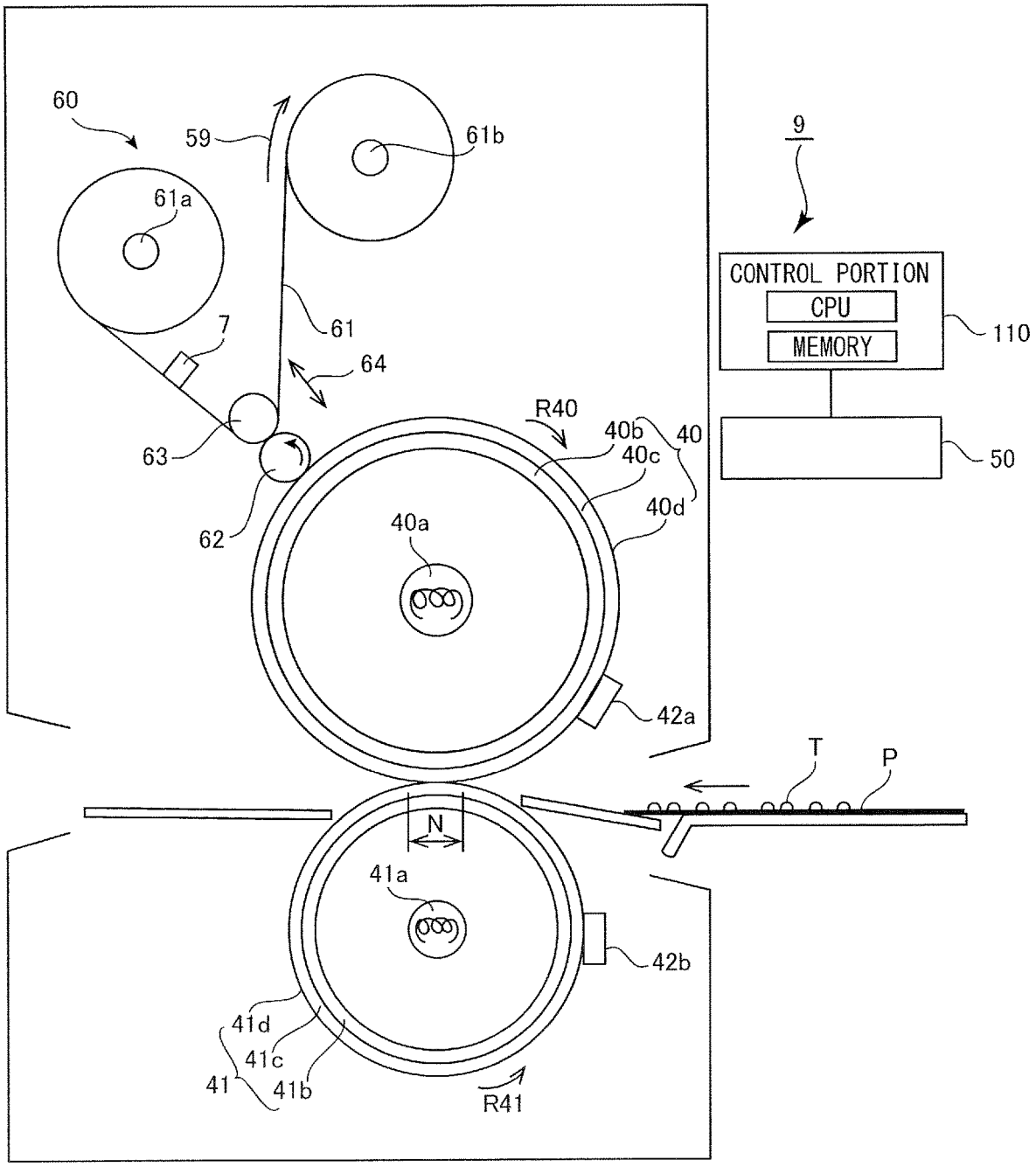
FIG. 2 is a schematic diagram illustrating a configuration of a fixing unit.

The fixing unit 9 will be described with reference to FIG. 2. As illustrated in FIG. 2, the fixing unit 9 includes a fixing roller 40 for heating the toner image on the recording material P, a pressure roller 41 for pressing the recording material P and a cleaning unit 60 for cleaning the fixing roller 40. The fixing and pressure rollers 40 and 41 rotate respectively in directions of arrows of R40 and R41 by being integrally and rotationally driven by a gear mechanism not illustrated in which gears are fixed to one axial ends of the respective rollers and are mutually connected with each other. The pressure roller 41 is in pressure contact with the fixing roller 40 with a total pressure of about 784 N, i.e., about 80 kg, and defines a nip portion N with the fixing roller 40. The recording material P is nipped and conveyed by the fixing roller 40 and the pressure roller 41, so that a non-fixed toner image T which has been transferred onto the recording material P is heated and is fixed onto the recording material P by passing through the nip portion N.

Both end portions of the fixing roller 40 are supported by ball bearings so that the fixing roller 40 is freely rotatable. The fixing roller 40 includes a core metal 40*b* of an aluminum cylinder for example and an elastic layer 40*c* of 3 mm thick formed around an outer circumferential surface of the core metal 40*b* and is constructed to be 60 mm in diameter. An under layer of the elastic layer 40*c* is formed of an HTV (high temperature vulcanizing) silicon rubber layer, and an outer circumferential surface of the HTV silicon rubber layer is formed of an RTV (room temperature vulcanizing) silicon rubber layer serving as a heat resistant elastic layer 40*d* that comes into contact with a surface of an image. A halogen heater 40*a* for heating the fixing roller 40 from inside is non-rotationally disposed at a center of rotation of the fixing roller 40.

Both end portions of the pressure roller 41 are supported by ball bearings, so that the pressure roller 41 is freely rotatable. The pressure roller 41 includes a core metal 41*b* of an aluminum cylinder for example and a pressure roller 41*c* of 1 mm thick formed around an outer circumferential surface of the core metal 41*b* and is constructed to be 60 mm in diameter. An under layer of the pressure roller 41*c* is formed of an HTV (high temperature vulcanizing) silicon rubber layer, and an outer circumferential surface of the HTV silicon rubber layer is formed of a fluorine resin layer serving as a releasing layer 41*d*. A halogen heater 41*a* for heating the pressure roller 41 from inside is non-rotationally disposed at a center of rotation of the pressure roller 41.

Releasability with respect to the toner is enhanced further by combining the fixing roller 40 and the pressure roller 41 having the layers constructed as described above. In a case of the present embodiment, the RTV (room temperature vulcanizing) silicon rubber layer having a high toner releasing effect is formed not only on the surface of the fixing roller 40 but also on the surface of the pressure roller 41 to fix both surfaces of the recording material P. Note that not only the RTV (room temperature vulcanizing) silicon rubber layer but also a LTV (low temperature vulcanizing) silicon rubber layer may be formed on the surfaces of the fixing rollers 40 and the pressure rollers 41.

In order to detect surface temperature of the fixing roller 40, a thermistor 42*a* is provided so as to be in contact with the surface of the fixing roller 40. A thermistor 42*b* is also provided so as to be in contact with the surface of the pressure roller 41 to detect surface temperature of the pressure roller 41. These thermistors 42*a* and 42*b* are connected with a temperature adjusting circuit 50 so as to be able to input/output signals to the circuit 50. Then, the temperature adjusting circuit 50 can adjust power supplied to the halogen heater 40*a* such that the surface temperature of the fixing roller 40 detected by the thermistor 42*a* is converged to target temperature, e.g., about 165°. The temperature adjusting circuit 50 can also adjust power supplied to the halogen heater 41*a* such that the surface temperature of the pressure roller 41 detected by the thermistor 42*b* is converged to target temperature, e.g., about 140°. The adjustments of the powers supplied to the halogen heater 40*a* and the halogen heater 41*a* made by the temperature adjusting circuit 50 are performed under control of a control portion 110.

An optimum heat quantity for melting the toner image on the recording material P is different depending on a thickness and a weight per unit area, i.e., grammage, of the recording material P. Then, the control portion 110 adjusts the supply power by controlling the temperature adjusting circuit 50 to change the surface temperature of the fixing roller 40 corresponding to a type of the recording material P. The control portion 110 includes a CPU (Central Processing Unit) and memories such as a ROM (Read Only Memory) and a RAM (Random Access Memory). Various programs such as an image forming job and various data are stored in the ROM. The CPU executes the various programs stored in the ROM to operate the image forming apparatus 100. Meanwhile, an operation data and input data are stored in the RAM, and the CPU can refer to the various data stored in the ROM and the RAM based on the various programs.

The image forming job is a series of operations from starting an image forming operation on the recording material P based on a print signal of the image to be formed until completing the image forming operation. That is, it is a series of operations from starting a preliminary operation, i.e., a so-called pre-rotation, required in forming the image until completing a preliminary operation, i.e., a so-called post-rotation, required in finishing to form the image through an image forming process. Specifically, the image forming job refers to a period from the pre-rotation, i.e., a warm-up operation before forming the image, until the post-rotation, i.e., an operation after forming the image, and includes an image forming period and an interval between sheets.

By the way, even if the control portion 110 adjusts the supply power, it takes a time until when the surface temperature of the fixing roller 40 converges to the target temperature. Due to that, the target temperature is set high in the control portion 110 corresponding to the recording material P that requires a large heat quantity to be able to heat many types of recording materials P with the same target temperature. However, in the case where the target temperature is set high, the heat quantity may become excessive for the recording material P that requires less heating quantity, and the toner melted by the heat is liable to adhere from the recording material P to the fixing roller 40. That is, a so-called hot offset phenomenon is liable to occur.

Then, in order to remove the toner adhering to the fixing roller 40 serving as a fixing member, the cleaning unit 60 having a cleaning web 61 is provided in the present embodiment. In the case of the present embodiment, the cleaning web 61 does not directly and frictionally slide with the fixing roller 40, and a collecting roller 62 that rotates in contact with the fixing roller 40 frictionally slides the fixing roller 40. That is, the toner on the fixing roller 40 is removed indirectly by the cleaning web 61. This arrangement makes it possible to hardly cause scratches on the surface of the fixing roller 40 and makes it to suppress a stripe image failure from being otherwise generated by the scratches on the surface of the fixing roller 40.

Cleaning Unit

Figure 3:
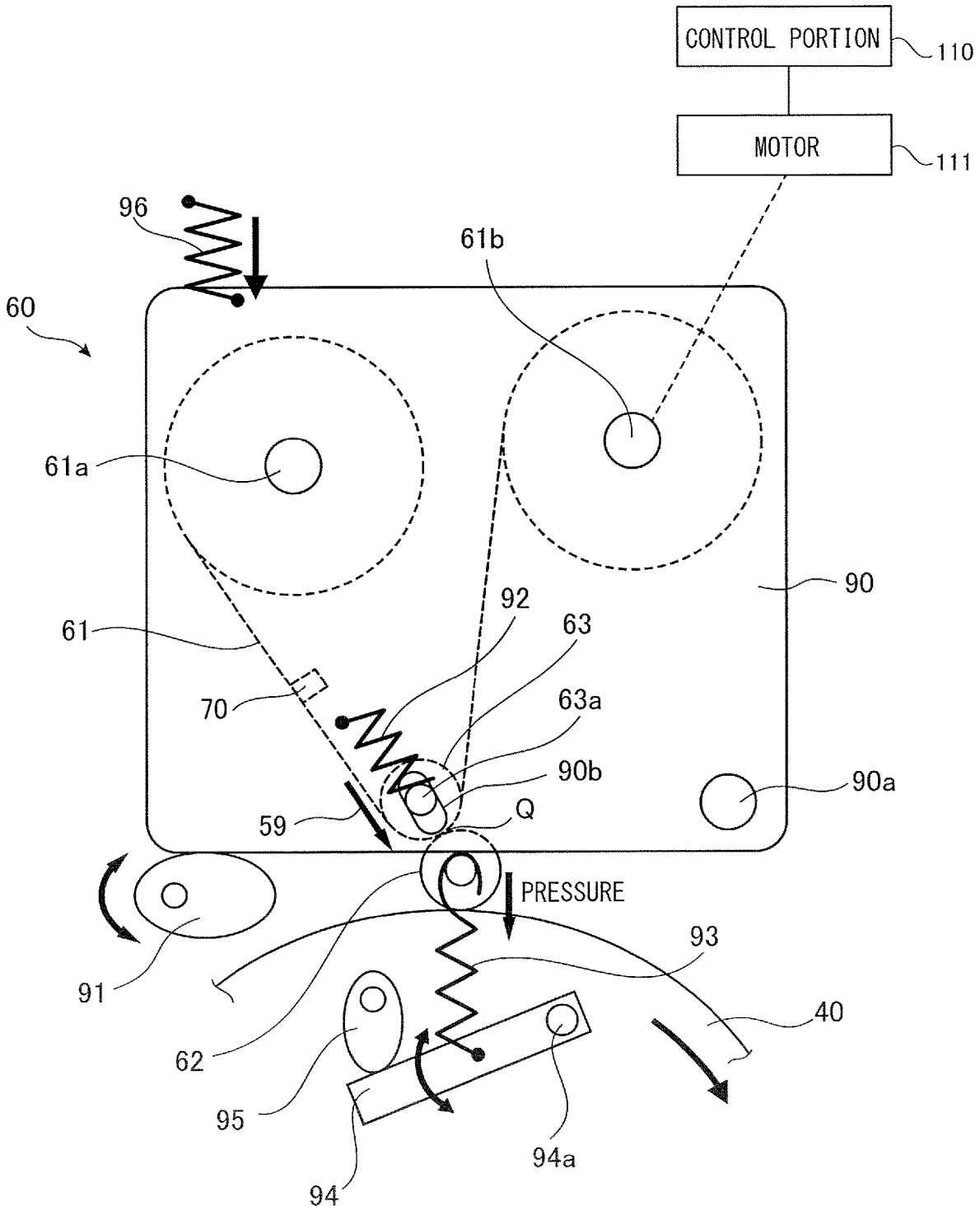
FIG. 3 is a schematic diagram illustrating a configuration of a cleaning unit.

The cleaning unit 60 will now be detailed with reference to FIG. 3. As illustrated in FIG. 3, the cleaning unit 60 includes the cleaning web 61 composed of a nonwoven cloth, the collecting roller 62 that rotates in contact with the fixing roller 40, and a web roller 63 for pressing the cleaning web 61 to the collecting roller 62. The cleaning unit 60 pivots centering on a supporting portion 90*a* to be able to switch the contact and separation of the cleaning web 61 with/from the collecting roller 62. The cleaning web 61 comes into contact with the collecting roller 62 serving as a rotary member at a contact position Q. The cleaning unit 60 is pressed against a web contact/separation switching cam 91 by a unit pressure spring 96.

The condition of the cleaning web 61 is switched by rotation of the web contact/separation switching cam 91 between a contact condition in which the cleaning web 61 is in contact with the collecting roller 62 and a separate condition in which the cleaning web 61 is distant from the collecting roller 62. The cleaning web 61 can remove the toner on the collecting roller 62 serving as a collecting member, i.e., the toner collected from the fixing roller 40, in the case where the cleaning web 61 is in contact with the contact condition and the fixing roller 40 rotates. Then, the cleaning web 61 is wound up in a direction of an arrow 59 in FIG. 3 as a motor 111 rotates. A part of the cleaning web 61 already used after wiping the toner is not repeatedly used and a non-used part by which the toner is to be wipe is used to adequately remove the toner by winding up the cleaning web 61. Note that in a case where the used part can sufficiently remove the toner, the used part may be repeatedly used to remove the toner.

The cleaning unit 60 also includes a web supply shaft 61*a*, a web wind-up shaft 61*b* serving as a moving unit and the motor 111. The cleaning web 61 is kept replaceably in a state of being wound up by the rotatable web supply shaft 61*a*, i.e., in a roll state. In attaching the cleaning web 61, a leading edge portion of the cleaning web 61 is engaged with the web wind-up shaft 61*b* which is connected with the motor 111 for rotating the web wind-up shaft 61*b*. As the motor 111 rotates and the web wind-up shaft 61*b* rotates, the web wind-up shaft 61*b* winds up the cleaning web 61. Meanwhile, as the web supply shaft 61*a* rotates following the winding operation of the cleaning web 61, the web supply shaft 61*a* delivers the cleaning web 61.

In order to suppress deflection that may be otherwise caused when the web roller 63 comes into contact with the collecting roller 62, a highly rigid metallic shaft, e.g., SUS303, is disposed at center of the web roller 63. In the web roller 63, the shaft is wrapped by a flexible and heat resistant silicon sponge of 30 mm in outer diameter for example to assure a nip width with the collecting roller 62 to be wide and to enhance cleaning ability. In the web roller 63, a surface of the silicon sponge is covered by a PFA tube of 100 μm in thickness for example such that the toner hardly adheres.

An end portion 63*a* of the web roller 63 is rotatably and slidably supported by a long round hole 90*b* defined through a side plate 90. A direction in which the end portion 63*a* slides in the long round hole 90*b* is a direction vertical to a tangential line of the web roller 63 and the collecting roller 62. The end portion 63*a* of the web roller 63 is pressurized toward the collecting roller 62 by a web roller pressure spring 92 fixed to the side plate 90.

The collecting roller 62 is a metallic, e.g., SUS 303, columnar member of 20 mm in outer diameter for example. In a case where the toner on the recording material P adheres to the fixing roller 40, the toner adhering to the fixing roller 40 is moved to the collecting roller 62 and is then removed by the cleaning web 61. The collecting roller 62 is always in contact with the surface of the fixing roller 40 for a purpose of removing adhesives other than the toner also in forming no images.

As the fixing roller 40 rotates, the collecting roller 62 rotates following the rotation of the fixing roller 40. Both end portions of the collecting roller 62 are supported by ball bearings supported movably in a direction of the fixing roller 40. The collecting roller 62 is pressurized toward the fixing roller 40 by a collecting roller pressure spring 93, a collecting roller pressure arm 94 and a collecting roller pressure cam 95. A first end of the collecting roller pressure spring 93 is fixed to an end of the collecting roller 62 and a second end of the collecting roller pressure spring 93 is fixed to the collecting roller pressure arm 94. As the collecting roller pressure cam 95 turns, the collecting roller pressure arm 94 pivots centering on a pivot shaft 94*a* and changes an operational length of the collecting roller pressure spring 93, so that a pressurization force of the collecting roller 62 to the fixing roller 40 is set to be variable. A variable range of the pressurization force of the collecting roller 62 to the fixing roller 40 is more "zero N" and less than "80 N" for example. Note that a rotation amount of the collecting roller 62 from a starting end of the cleaning web 61 is stored in a memory (see FIG. 2) of the control portion 110.

Detection of Wind-Up Amount of Cleaning Web

As described above, the toner adhering to the fixing roller 40 is not directly removed by frictionally sliding the cleaning web 61 with the fixing roller 40 in the present embodiment. In the present embodiment, the toner adhering to the fixing roller 40 is indirectly removed through the collecting roller 62 by frictionally sliding the collecting roller 62 with the cleaning web 61. In a case where the cleaning web 61 is used up, however, the web wind-up shaft 61*b* can wind up no more cleaning web. Therefore, because the cleaning web 61 repeatedly and frictionally slides the collecting roller 62 at a same spot, the toner is liable to be left on the collecting roller 62. In such a case, the toner adhering on the fixing roller 40 may be rotated together without being removed. Then, the toner on the fixing roller 40 adheres to the recording material P in fixing an image, thus appearing on the recording material P as toner soiling. That is, a quality of the output image drops. Then, it is configured to be able to detect a wind-up amount, i.e., a usage, of the cleaning web 61 in the present embodiment. A method for detecting the wind-up amount of the cleaning web 61 will be described below with reference to FIGS. 4 through 6B.

Figure 4:
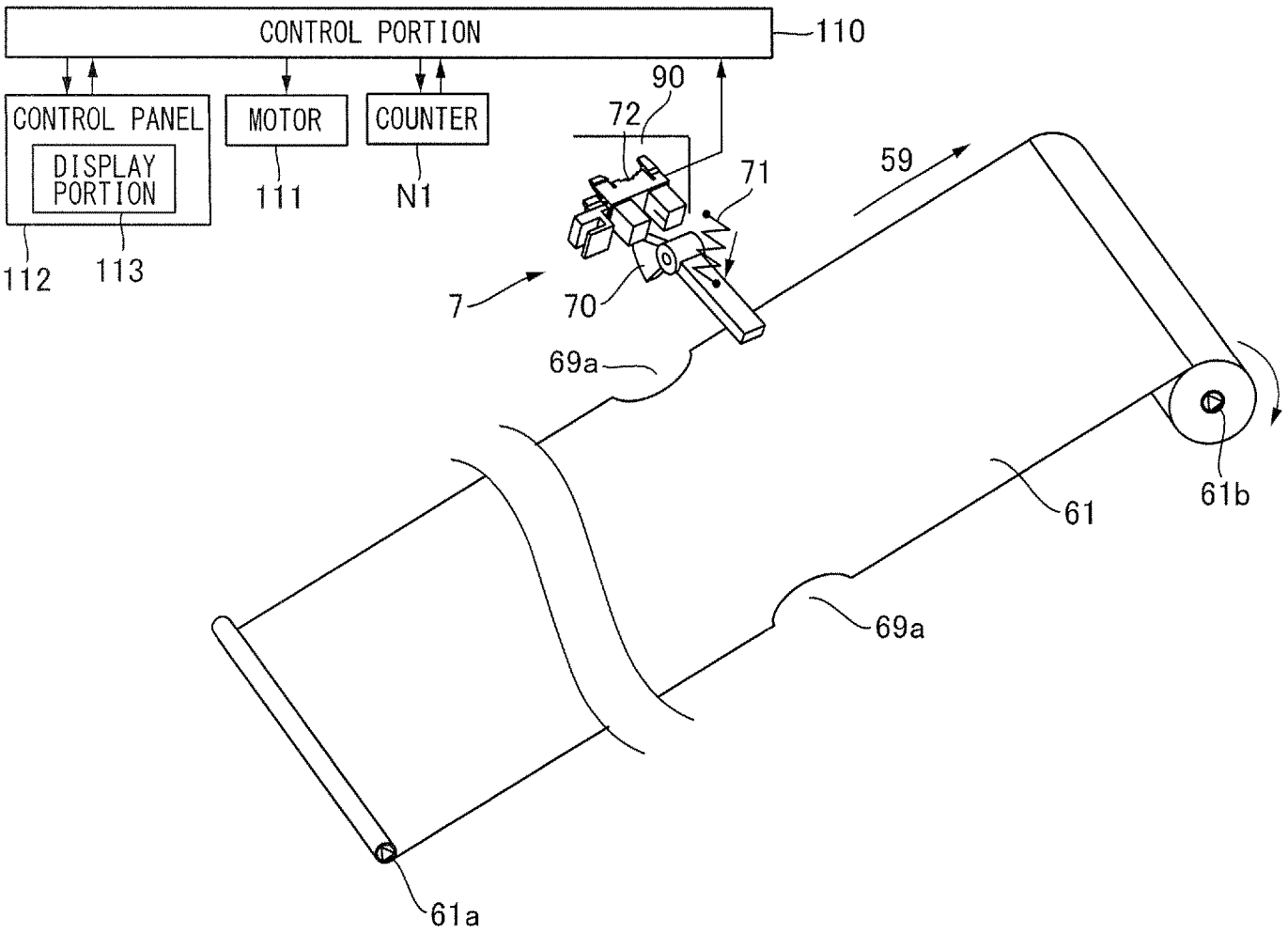
FIG. 4 illustrates a method for detecting a wind-up amount of a cleaning web.

The control portion 110 causes the motor 111 to rotate the web wind-up shaft 61*b* such that the cleaning web 61 moves in a direction of an arrow 59 in FIG. 4 every time when the image formation is made to a predetermined unit number of recording materials P. In the present embodiment, a moving amount of the cleaning web 61 per sheet of the recording material P, i.e., a moving amount per one winding operation, is set to be "0.5 mm per one winding operation" in terms of horizontal feed of an A4 size sheet. Note that the moving amount per one winding operation of the cleaning web 61, i.e., a wind-up amount per one winding operation, may be set such that the cleaning web 61 is wound up by "0.5 mm" every time when the image formation is made on ten sheets of recording materials P for example. Or, a unit wind-up amount of the cleaning web 61 per unit rotation amount of the collecting roller 62 may be set in the memory, and the control portion 110 may be caused to drive the web wind-up shaft 61*b* to wind up the cleaning web 61 corresponding to a rotation amount of the collecting roller 62.

As illustrated in FIG. 4, the cleaning web 61 is provided with a notch 69*a* defined at an edge in a width direction intersecting with the moving direction in which the cleaning web 61 is wound up. A notch sensor 7 serving as a detecting unit is fixed to the side plate 90 so that it is disposed along a moving path of the cleaning web 61 to be able to detect the notch 69*a* along with the winding operation of the cleaning web 61.

Figure 5A:
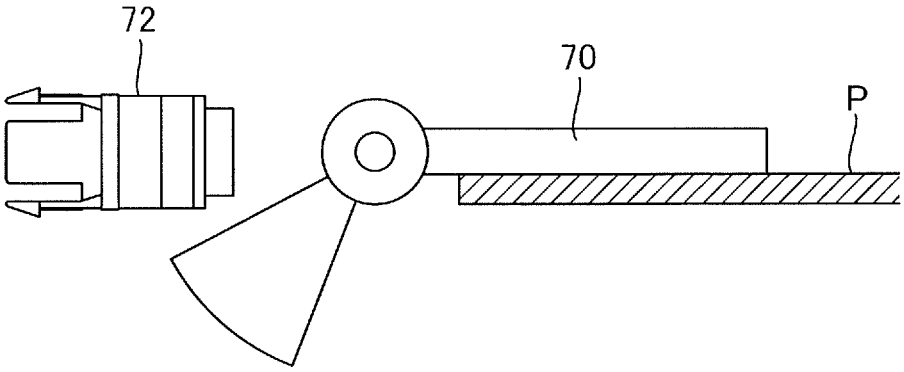
FIG. 5A is a side view illustrating an operation of a notch sensor in a condition before detecting a notch.
Figure 5B:
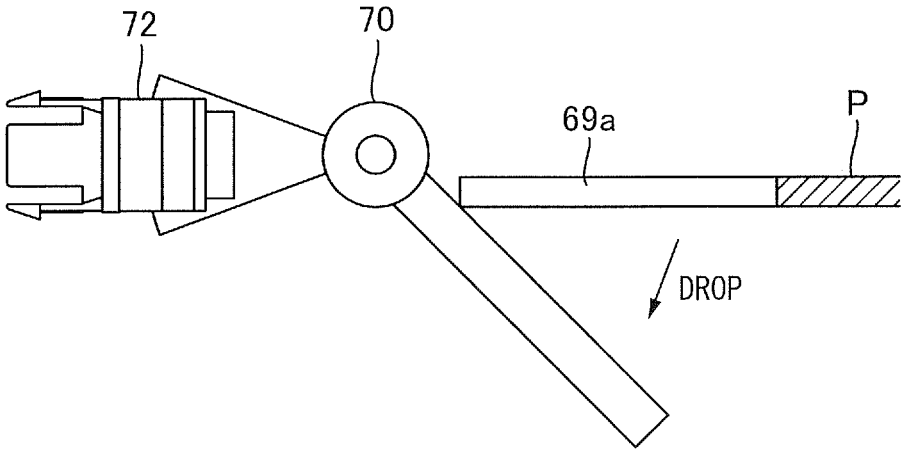
FIG. 5B is a side view illustrating the operation of the notch sensor in a condition after detecting the notch.

The notch sensor 7 includes a flag 70, a web flag spring 71 and a photo sensor 72. The web flag spring 71 urges the flag 70 toward the cleaning web 61 such that the flag 70 comes into contact with the cleaning web 61. The notch sensor 7 detects the notch 69*a* of the cleaning web 61 by the photo sensor 72. The photo sensor 72 includes a light emitting component and a photo-sensing portion and is connected to the control portion 110. The photo sensor 72 detects the notch 69*a* of the cleaning web 61 by detecting whether it is a light transmitting condition in which light emitted from the light emitting component is received by the photo-sensing portion or is a light shielding condition in which the light is not received by the photo-sensing portion. As illustrated in FIG. 5A, in the case of a contact condition in which the flag 70 is in contact with the cleaning web 61, the photo sensor 72 is in the light transmitting condition (OFF) because the light is not shielded between the light emitting component and the photo-sensing portion. Meanwhile, if the contact condition of the flag 70 is released as illustrated in FIG. 5B, the light is shielded by the flag 70 between the light emitting component and the photo-sensing portion, and the photo sensor 72 is switched to the light shielding condition (ON).

Figure 6A:
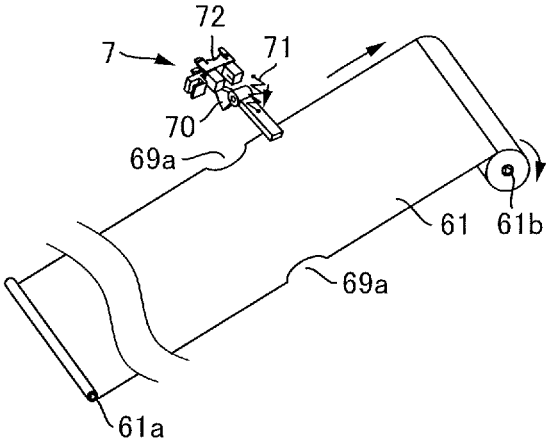
FIG. 6A is a perspective view illustrating the operation of the notch sensor in a condition before detecting the notch.
Figure 6B:
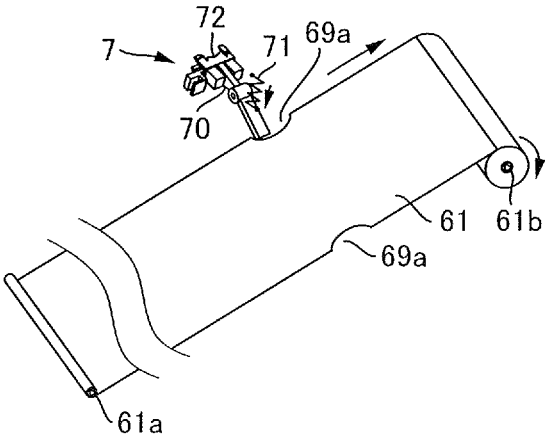
FIG. 6B is a perspective view illustrating the operation of the notch sensor in a condition after detecting the notch.

Then, because the contact condition of the flag 70 is not released from a leading edge of the cleaning web 61 to the notch 69*a* as illustrated in FIG. 6A, the photo sensor 72 is kept in the light transmitting condition. Meanwhile, as the notch 69*a* of the cleaning web 61 arrives at the flag 70 as illustrated in FIG. 6B, the contact condition of the flag 70 is released and the photo sensor 72 is shifted from the light transmitting condition to the light shielding condition and is then kept in the light shielding condition. Thus, the notch sensor 7 can detect the notch 69*a* of the cleaning web 61 as the photo sensor 72 is switched from the light transmitting condition to the light shielding condition as the notch 69*a* arrives at the flag 70. Then, the control portion 110 can specify a wind-up amount of the cleaning web 61 accordingly as the photo sensor 72 detects the notch 69*a*.

The notch 69*a* is defined at a position where a length from the starting end of the cleaning web 61 is "60%" of a whole length of the cleaning web 61 for example. For instance, if the whole length of the cleaning web 61 is "100 meters", the notch 69*a* is defined at a predetermined position where the length from the starting end of the cleaning web 61 is "60 meters". Then, if an actual moving amount of the cleaning web 61 is set to be "0.5 mm/one winding operation", the notch sensor 7 can detect the notch 69*a* after conducting the image formation to about 12,000 sheets of recording materials P after replacing to a new cleaning web 61. In this case, because the wind-up amount of the cleaning web 61 is specified to be "60 meters", a remaining web amount is "40 meters". In the present embodiment, an average wind-up amount of the cleaning web 61 wound by the web wind-up shaft 61*b* per unit number of sheets will be referred to as the "actual moving amount per one winding operation".

Note that the control portion 110 is connected also with a counter N1 and a control panel 112 as illustrated in FIG. 4. The counter N1 counts up a "web feed number of times, i.e., a wind-up number of times, by "1" each every time when the operation of winding up the cleaning web 61 is carried out once while setting beginning of the use of the cleaning web 61 as "0" number of times. The control portion 110 acquires the "web feed number of times" counted by the counter N1. The control panel 112 includes a display portion 113 enabling to inform the user of the replacement, an operational error or the like and of various control programs such as the image forming job. The display portion 113 is a liquid crystal display screen for example. In informing the user of the replacement of the cleaning web 61 in the case of the present embodiment, it is also possible to arrange to inform the user by flickering by a LED or by generating an alarm sound through a speaker for example without indicating on the display portion 113.

By the way, although the moving amount per predetermined one winding operation of the cleaning web 61 is set as "0.5 mm/one winding operation" in the present embodiment, the actual moving amount per number of times of the actual operation may be different per each individual cleaning unit. That is, the actual moving amount per one time of the winding operation of the cleaning web 61 may be vary in a range of "0.1 mm/one winding operation" to "2.0 mm/one winding operation" for example due to the individual difference caused by difference of assembling and component accuracies of the cleaning unit 60.

If the actual moving amount per one winding operation of the cleaning web 61 thus differs, the cleaning web 61 may be almost wound up earlier than what the user has expected after detecting the notch 69*a*. In such a case, if the user continues to execute the image formation without noticing that, the collecting roller 62 may frictionally slides with the cleaning web 61 to which a large amount of toner has adhered. Then, the toner of the cleaning web 61 adheres again to the fixing roller 40, possibly causing soiling of the toner. Still further, even if the user notices that, the user is unable to form images until the user prepares a new cleaning web 61 and replaces the used cleaning web. Thus, a downtime of the image forming apparatus 100 is prolonged, and it becomes difficult to efficiently operate the image forming apparatus 100. Or, there is a case where the cleaning web 61 is replaced regardless much amount of the cleaning web 61 is left and can be still used.

Then, according to the present embodiment, the "actual moving amount per one winding operation of the cleaning web 61" until reaching the notch 69*a* defined in the cleaning web 61 is calculated to be able to specify the wind-up amount of the cleaning web 61 based on the actual moving amount. In the present embodiment, the wind-up amount of the cleaning web 61 is specified based on a "LIFE value". The "LIFE value" is what the wind-up amount, i.e., a usage, of the cleaning web 61 is represented by %, where the whole length of the cleaning web 61 is "100%". That is, the "LIFE value" of a new cleaning web 61 is "0%", i.e., "100%" in terms of a web remaining amount, and the LIFE value of the cleaning web 61 which has been all used up is "100%", i.e., "0%" in terms of the web remaining amount. Then, it is arranged to be able to inform the user of a "request to replace the cleaning web 61" by using the display portion 113 in accordance to the wind-up amount of the cleaning web 61 specified based on the "actual moving amount per one winding operation of the cleaning web 61". This point will now be detailed below.

A "replacement informing process" of a first embodiment will be described with reference to FIGS. 1 through 4 and by using FIG. 7. The "replacement informing process" of the present embodiment is started by the control portion 110 together with start of execution of the image forming job.

Figure 7:
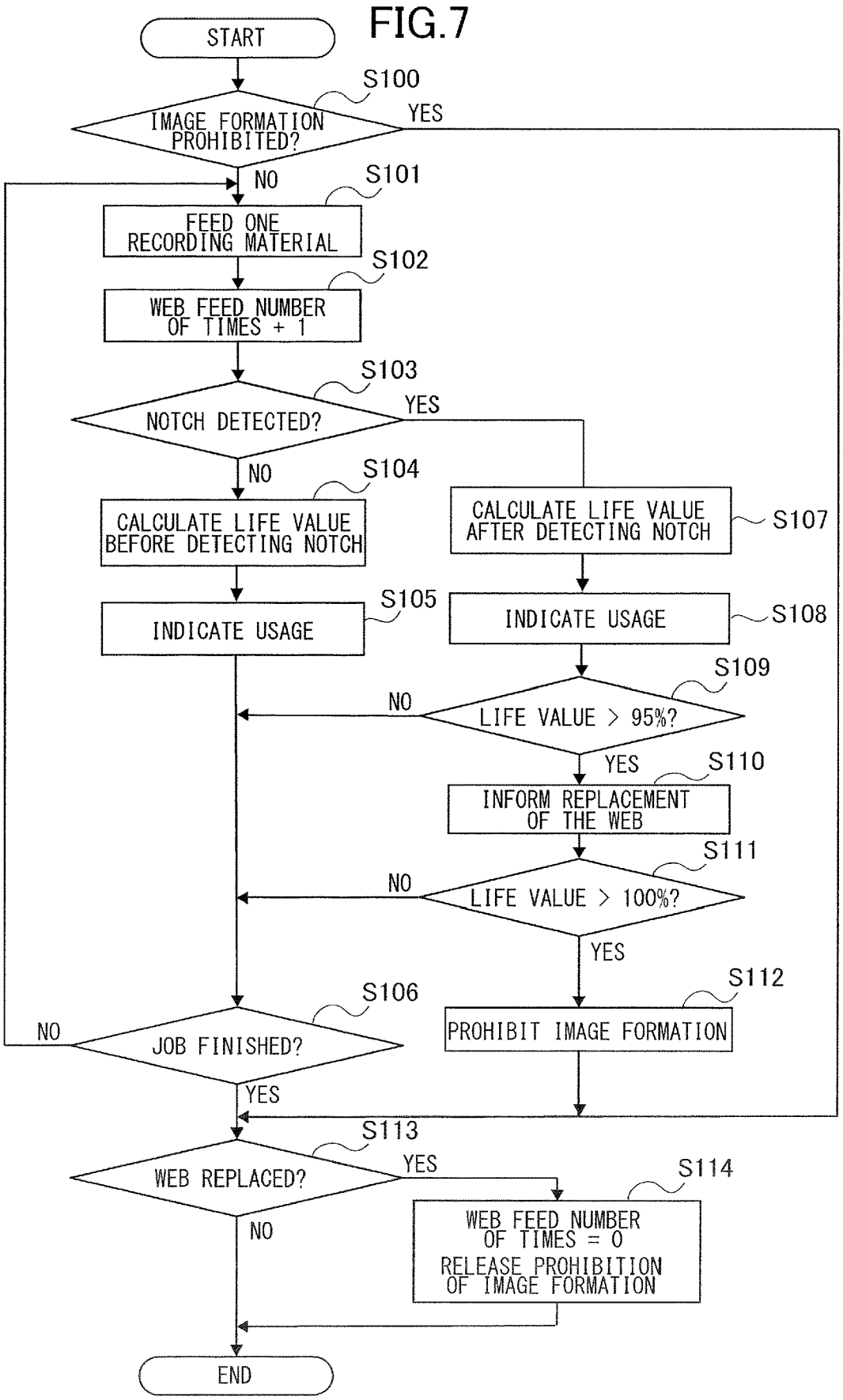
FIG. 7 is a flowchart indicating a replacement informing process of a first embodiment.

As illustrated in FIG. 7, the control portion 110 determines whether a present time is in a condition of being "image formation prohibited" in Step S100. That is, because soiling of toner may occur if an image forming job is started in a condition in which the cleaning web 61 has been all used up, it is determined whether the "image formation prohibited" of not permitting to execute the image forming job has been set even if the start of execution of the image forming job is instructed. In a case where the "image formation prohibited" has been set, i.e., Yes in Step S100, the control portion 110 jumps to a process in Step S113. In a case where the "image formation prohibited" is not set, i.e., No in Step S100, the control portion 110 increments, i.e., counts up, a "web feed number of times", by "+1" each by the counter N1 in Step S102. It is noted that the increment of the "web feed number of times" is differentiated corresponding to size and a direction of feed of the recording material P. In a case where an A4 size sheet of landscape orientation is fed, the "web feed number of times" is set to be "+1" and where an A3 size sheet of landscape orientation is fed, the "web feed number of times" is set to be "+2" for example.

Next, the control portion 110 determined whether the notch sensor 7 has detected the notch 69*a* of the cleaning web 61 in Step S103. If the notch sensor 7 has not detected the notch 69*a* yet, i.e., No in Step S103, the control portion 110 determines as being "before detecting the notch" and finds the "LIFE value" in accordance to the following Equation 1 in Step S104.

$$\text{LIFE value}(\%)=\text{web feed number of times}/\text{supposed feed number of times}\times 100 \quad \text{Eq.1}$$

For instance, in a case where the whole length of the cleaning web 61 is 100 meters and the moving amount per one winding operation of the cleaning web 61 is set to be "0.5 mm/one winding operation", the supposed feed number of times is 200,000 times. In this case, if the actual moving amount per one winding operation of the cleaning web 61 is also "0.5 mm/one winding operation", the cleaning web 61 is used up by winding the cleaning web 61 by 200,000 times.

After processing in Step S104 described above, the control portion 110 indicates the wind-up amount of the web on the display portion 113 corresponding to an operation made by the user in Step S105. Here, the indication of the wind-up amount of the web is the LIFE value (first usage) of "before detecting the notch" found by Equation 1. The user can understand an approximate standard of the replacing timing of the cleaning web 61 before informing a replacement of the web by the indication of the wind-up amount of the web corresponding to the operation of the user. Then, the control portion 110 determines whether an instruction of finishing the image forming job has been made in Step S106. In a case where the instruction of finishing the image forming job is not made yet, i.e., No in Step S106, the control portion 110 returns to the process in Step S101. Meanwhile, in a case where the instruction of finishing the image forming job has been made, i.e., Yes in Step S106, the control portion 110 advances to a process in Step S113.

In a case where the notch sensor 7 detects the notch 69*a*, i.e., Yes in Step S103, the control portion 110 determines to be "after detecting the notch" and finds the "LIFE value" in Step S107 in accordance to the following Equation 2 in Step S107.

$$\text{LIFE value}(\%)=(\text{actual moving amount per one winding operation of the cleaning web } \mathbf{61})\times\text{web feed number of times}/\text{web whole length(mm)}\times 100 \quad \text{Eq. 2}$$

The "actual moving amount per one winding operation of the cleaning web 61" (mm/one winding operation) within Equation 2 is obtained by the following Equation 3. In the case of the present embodiment, a length of the web from the starting end to the notch 69*a* of the cleaning web 61 is "60 meters".

$$\text{actual moving amount per one winding operation of the cleaning web 61}=(\text{length of web(mm) from the starting end to the notch } 69a \text{ of the cleaning web 61}/\text{web feed number of times until detecting the notch } 69a) \quad \text{Eq. 3}$$

Corresponding to the operation of the control panel 112 (see FIG. 4) made by the user, the control portion 110 indicates the wind-up amount of the web on the display portion 113 in Step S108. The wind-up amount of the web indicated here is a LIFE value (second usage) of "after detecting the notch" found by Equation 2. That is, the control portion 110 switches the wind-up amount of the web indicated on the display portion 113 from the abovementioned first usage to the second usage. Then, the control portion 110 determines whether the LIFE value of Equation 2 of the "after detecting the notch" is greater than "95%" for example in Step S109. In the case where the LIFE value of Equation 2 is not greater than "95%", i.e., No in Step S109, the control portion 110 jumps to the process in Step S106. Meanwhile, the LIFE value of Equation 2 is greater than "95%", i.e., Yes in Step S109, the control portion 110 informs the user of "replacement of the cleaning web 61" in Step S110. In informing the user of the replacement of the cleaning web 61, a replacement message urging that "only a small amount of the cleaning web 61 is left and the cleaning web 61 needs to be replaced soon" is displayed for example. In the case of the present embodiment, if an actual moving amount per one winding operation is a first moving amount, the replacement of the web is informed when a number of sheets of the recording materials on which images have been formed during a period "after detecting the notch" is a first number of sheets. Then, if the actual moving amount per one winding operation is a second moving amount which is greater than the first moving amount, the replacement of the web is informed when the number of sheets on which the images have been formed is a second number of sheets which is less than the first number of sheets. Note that in the case of the present embodiment, the control portion 110 enables to execute the image forming job without setting the "image formation prohibited" by which the execution of the image forming job is not permitted until when the LIFE value of Equation 2 becomes more than "100%".

The control portion 110 determines also whether the LIFE value of Equation 2 of "after detecting the notch" described above is more than "100%" in Step S111. In a case where the LIFE value of Equation 2 is less "100%", i.e., No in Step S111, the control portion 110 jumps to the process in Step S106. Meanwhile, in a case where the LIFE value of Equation 2 is more than "100%", i.e., Yes in Step S111, the control portion 110 sets the "image formation prohibited" of not permitting to execute the image forming job in Step S112. In the case of the present embodiment, if the actual moving amount per one winding operation is a first moving amount, the control portion 110 prohibits to form toner images onto the recording materials P when a number of sheets of recording materials onto which images have been formed after informing the replacement of the web is a third number of sheets. Then, if the actual moving amount per one winding operation is a second moving amount which is greater than the first moving amount, the control portion 110 prohibits to form toner images onto the recording materials P when a number of sheets of the recording materials on which images have been formed after informing the replacement of the web is a fourth number of sheets which is less than the third number of sheets. In the case when the image formation is prohibited, the control portion 110 finishes the image forming job being executed. The control portion 110 does not also accept starting of a new image forming job. Meanwhile, the control portion 110 keeps the display of the replacement message displayed on the display portion 113 and then advances to a process in Step S113.

The control portion 110 determines whether the cleaning web 61 has been replaced in Step S113. In a case where the cleaning web 61 has not been replaced, i.e., No in Step S113, the control portion 110 finishes the "replacement informing process". Meanwhile, in a case where the cleaning web 61 has been replaced, i.e., Yes in Step S113, the control portion 110 clears the "web feed number of times" to "zero time" and releases the setting of the "image formation prohibited" in Step S114. The control portion 110 also erases the display of the replacement message on the control panel 112. After that, the control portion 110 finishes the "replacement informing process".

Figure 8:
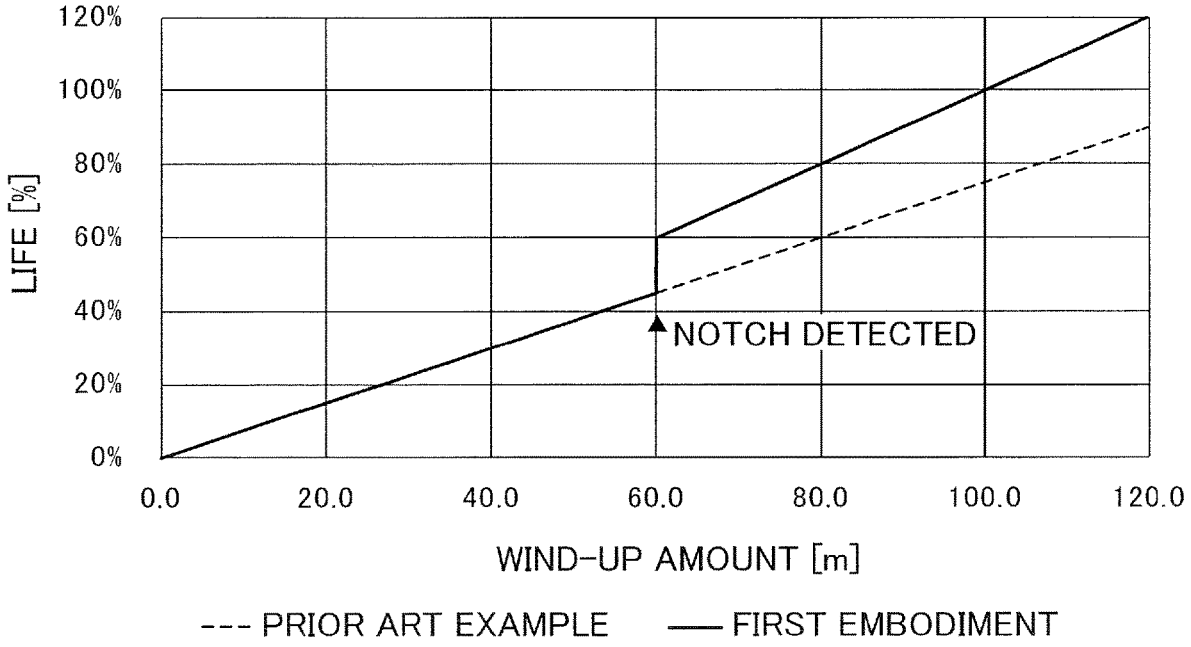
FIG. 8 is a graph indicating a relationship between a LIFE value and a web wind-up amount.

In order to compare the present embodiment with a prior art example, FIG. 8 illustrates transitions of respective LIFE values corresponding to web wind-up amounts in cases of the present embodiment and of the prior art example. The LIFE value of the prior art example can be found always by Equation 1 described above regardless of the detection of the notch 69*a*. In FIG. 8, a horizontal axis represents the wind-up amount (meter) of the cleaning web 61 and a vertical axis represents the LIFE value (%).

A dot line in FIG. 8 indicates the case of the prior art example. That is, this is a case where variation of the moving amount per one winding operation of the cleaning web 61 caused by individual difference of the cleaning unit 60 is not corrected and is a case where the "LIFE value" is found by Equation 1 regardless whether before or after the detection of the notch 69*a*. In the case of the prior art example, even in a condition in which the cleaning web 61 is used up and the wind-up amount is 100 meters, the LIFE value of Equation 1 increments only to around "75%", possibly executing the image forming job and causing soiling of toner. It is possible to suppress such soiling of toner by decreasing the "supposed feed number of times" in Equation 1. In such a case, however, it is difficult to adopt such arrangement because the replacement of the cleaning web 61 is made regardless of that much amount of the cleaning web 61 is left and can be still used, thus possibly inviting an increase of a cost.

In the case of the present embodiment, however, it is possible to suppress the soiling of toner and the increase of the cost involved in an increase of replacement frequency of the cleaning web 61 by finding the LIFE value by Equation 1 before detecting the notch and by finding the LIFE value by Equation 2 after detecting the notch. A solid line in FIG. 8 illustrates the case of the present embodiment. In the case of the present embodiment, the transition of the LIFE value until finding the notch is the same with the prior art example because the LIFE value is found by Equation 1. Because a position where the notch is defined is known at the moment when the notch is detected, it is possible to obtain the "actual moving amount per one winding operation of the cleaning web 61" (see Equation 3 described above). Then, because the LIFE value is found based on the "actual moving amount per one winding operation of the cleaning web 61" (see Equation 2 described above) after detecting the notch, the LIFE value of Equation 2 becomes "100%" in a condition of 100 meters of wind-up amount by which the cleaning web 61 is used up.

As described above, according to the present embodiment, the wind-up amount of the cleaning web 61 is specified based on the "actual moving amount per one winding operation of the cleaning web 61", and an arrangement of informing the replacement of the cleaning web 61 is made accordingly. Thereby, even if the "actual moving amount per one winding operation of the cleaning web 61" varies depending on the individual difference of the cleaning unit 60, it is possible to inform the replacement of the cleaning web 61 at an appropriate timing reflecting the "actual moving amount per one winding operation of the cleaning web 61". Accordingly, it is possible to suppress the downtime of the image forming apparatus from being prolonged and to suppress the cleaning web 61 from being replaced even though it is still usable.

Note that the control portion 110 may obtain the actual moving amount of the web per unit rotation amount from a rotation amount of the collecting roller 62 and the length of the cleaning web 61 between the starting end of the cleaning web 61 to the notch 69*a* stored in the memory based on that the notch 69*a* has been detected. In this case, it is also possible to inform the replacement of the cleaning web 61 based on the actual moving amount of the web per unit rotation amount and a remaining length of the cleaning web 61.

Second Embodiment

Figure 9:
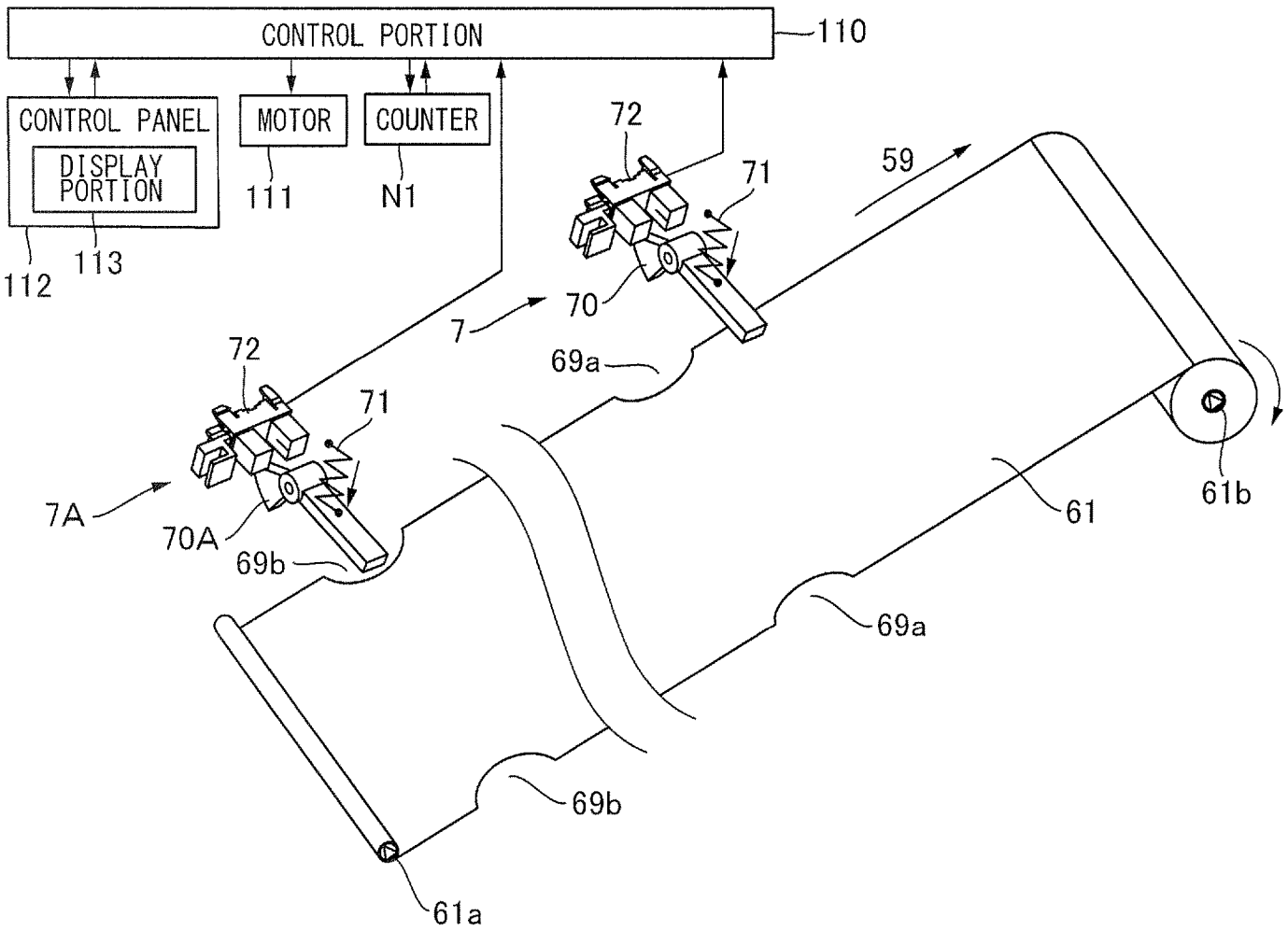
FIG. 9 is a perspective view illustrating each operation of two notch sensors according to a second embodiment.

Next, a second embodiment will be described with reference to FIGS. 9 and 10. In the case of the first embodiment described above, the cleaning web 61 is provided with the notch 69*a*, and the notch sensor 7 is provided to be able to detect the notch 69*a*. In the second embodiment, however, the cleaning web 61 is provided with another notch 69*b* in addition to the notch 69*a* as illustrated in FIG. 9. According to the present embodiment, the notch 69*b* is defined at an upstream position upstream (see the direction of the arrow 59 in FIG. 9) of the predetermined position where the notch 69*a* is defined in a moving direction of the cleaning web 61 on the same end side with the notch 69*a*. Then, in order to detect the other notch 69*b*, a notch sensor 7A is provided on the same end side with the notch sensor 7 which capable of detecting the notch 69*a*.

The notch sensor 7 can detect only the notch 69*a*, and the notch sensor 7A can detect only the notch 69*b*. In order for that, the notch 69*a* and the other notch 69*b* are defined such that their sizes, i.e., lengths from an edge, are different in terms of the width direction of the cleaning web 61. For instance, the notch 69*a* is defined to have "15 mm" of maximum length from the edge, and the other notch 69*b* is defined to have "25 mm" of maximum length from the edge, respectively. Then, in order to differentiate detection timing of the notch 69*a* detected by the notch sensor 7 from detection timing of the notch 69*b* detected by the notch sensor 7A, lengths of flags 70 and 70A are differentiated. That is, the flag 70A of the notch sensor 7A is formed to be longer than the flag 70 of the notch sensor 7. Thereby, the notch sensor 7 can detect the notch 69*a* because the contact condition of the flag 70 is released when the notch 69*a* passes through. Meanwhile, the notch sensor 7A can detect the notch 69*b* because the contact condition of the flag 70A is not released when the notch 69*a* passes through and the contact condition of the flag 70A is released when the notch 69*b* passes through.

As described above, according to the present embodiment, the notch 69*a* is defined at a position where a length from the starting end of the cleaning web 61 is "60 meters". Then, if the actual moving amount per one winding operation of the cleaning web 61 is "0.5 mm/per one winding operation", the notch sensor 7 detects the notch 69*a* as images have been formed on "about 12,000 sheets" of recording materials P after the replacing the cleaning web 61. Meanwhile, the notch 69*b* is defined at a position where a length from the starting end of the cleaning web 61 is "100 meters".

The "replacement informing process" of the second embodiment will be described with reference to FIGS. 1 through 4 and by using FIG. 10. The "replacement informing process" of the second embodiment illustrated in FIG. 10 is different from the "replacement informing process" of the first embodiment illustrated in FIG. 7 in that processes of Steps S201 and S202 are added, so that their processes will be mainly described. The processes other than those processes are the same with the "replacement informing process" of the first embodiment, so that their description will be simplified by denoting the same reference numerals or will be omitted. Note that the control portion 110 determines whether it is a condition in which the notch sensor 7 has detected the notch 69*a* of the cleaning web 61 in detecting a first notch in Step S103.

Figure 10:
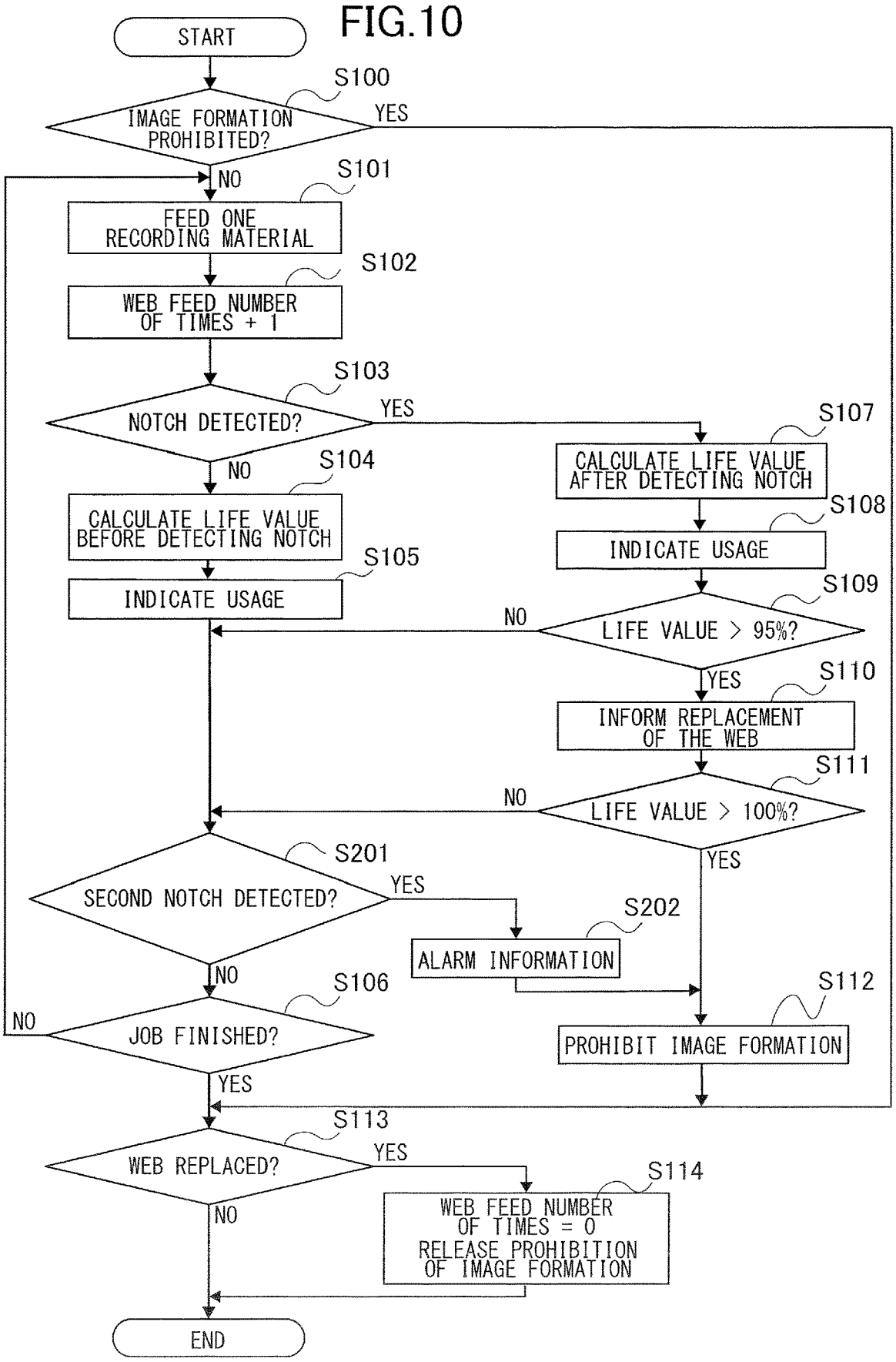
FIG. 10 is a flowchart indicating a replacement informing process of the second embodiment.

As illustrated in FIG. 10, in a case where the process in Step S109 is No and where the process in Step S111 is also No after the process of Step S105, the control portion 110 determines whether the notch sensor 7A has detected the second notch 69*b* in Step S201.

Then, in a case where the notch sensor 7A has not detected the second notch 69*b*, i.e., No in Step S201, the control portion 110 advances to the process in Step S106. Meanwhile, in a case where the notch sensor 7A has detected the second notch 69*b*, i.e., Yes in Step S201, the control portion 110 informs the user of an alarm of "urgently replace the cleaning web 61" in Step S202. The information of "urgently replace the cleaning web 61" may be an alarm message saying "Please immediately replace the cleaning web 61 because the cleaning web 61 has run out" for example to be displayed on the display portion 113. Because the control portion 110 sets "image formation prohibited" of not permitting to execute the image forming job at this time in Step S112, the image forming job being executed is finished. The control portion 110 also does not accept starting of a new image forming job.

As described above, according to the present embodiment, the second notch 69*b* enables to forcefully prohibit the image forming job by detecting the run-out of the cleaning web 61. This arrangement makes it possible to prevent soiling of toner caused by the cleaning web 61 because the cleaning web 61 is not continuously used in the condition of being used up even if the wind-up amount of the cleaning web 61 based on the LIFE value is erroneous.

Note that it is preferable to define the second notch 69*b* not at the position of "100 meters" which is the used up position of the cleaning web 61 but at a position of "99.5 meters" where the cleaning web 61 is still left before using up, due to the following reasons. In a case where the cleaning web 61 is used up during execution of the image forming job in which images are formed continuously on a plurality of recording materials P, originally it is desirable to immediately set the "image formation prohibited" of not permitting the execution of the image forming job and to urge the user to replace the cleaning web 61. However, in order to release the "image formation prohibited" by replacing the cleaning web 61, a downtime of the image forming apparatus 100 is apt to be large because it takes not only for a replacement time but also for a cooling time of the fixing unit 9 before the replacement and for a heating time of the fixing unit 9 after the replacement. Still further, in a case where the cleaning web 61 is used up in a situation in which dozen sheets are just left in forming images continuously on a large amount of recording materials P of thousand for example, it is more efficient to finish the remaining image formation if no soiling of toner occurs. In view of that, it is preferable to continue the image forming job and to finish the remaining image formation even after noticing the user.

Note that it is preferable to use the LIFE equation (see Equation 2) finding the LIFE value of the "after detecting the notch" as it is after replacing the cleaning web 61. That is the control portion 110 informs, in a case where a first replacement of the web has been carried out, a replacement of the web after the first replacement based on the actual moving amount per one winding operation obtained before the first replacement. Specifically, it is effective for a user often printing a large amount at a time. That is, in a case of such user, there is a possibility of using up the cleaning web 61 relatively quickly in a short period of time after the replacement of the web has been informed (see Step S108 in FIG. 7). In view of that, it is desirable to inform the replacement of the web when the wind-up amount of the cleaning web 61 is around 55%, i.e., 45% of the web remaining amount, depending on the user. In the cases of the first and second embodiments described above however, it is unable to detect the wind-up amount of the cleaning web 61 based on the "actual moving amount per one winding operation of the cleaning web 61" until when the notch 69*a* is detected. Then, there is a possibility that the replacement of the web is informed even in a condition in which the wind-up amount of the cleaning web 61 does not actually reach 55% and much of the cleaning web 61 is left. In view of that, the LIFE equation (see Equation 2) finding the LIFE value of the "after detecting the notch" is used as it is after replacing the cleaning web 61 to grasp the wind-up amount of the cleaning web 61 from beginning after the replacement of the cleaning web 61.

Figure 11:
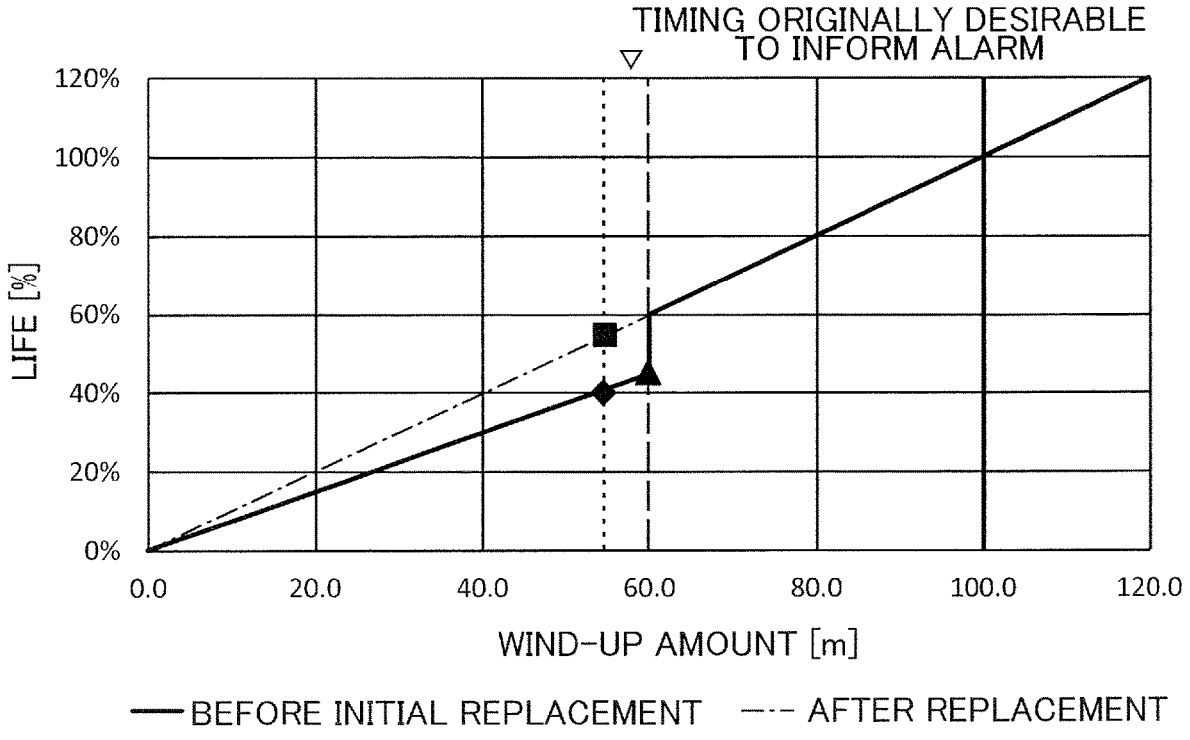
FIG. 11 is a graph illustrating a case of using a LIFE value after detecting the notch after replacing a web.

This arrangement will be described with reference to FIG. 11. In a case where the cleaning web 61 already mounted in advance in initial shipping is used, the LIFE value is found by the LIFE equation represented by Equation 1 described above until when the notch 69*a* is detected before initially replacing the cleaning web 61 (indicated by a solid line in FIG. 11). Then, after detecting the notch 69*a* (triangular mark in FIG. 11), the LIFE value is found by the LIFE equation represented by Equation 2 described above in accordance to the "actual moving amount per one winding operation of the cleaning web 61". After that, in a case where the cleaning web 61 is replaced, the LIFE value is found by the LIFE equation not of Equation 1 but of Equation 2 (dot chain line in FIG. 11). It is because "the moving amount per one winding operation of the cleaning web 61" is not influenced by the replacement of the cleaning web 61.

Assume a case where the replacement informing process is made in the same manner with the case before initially replacement of the cleaning web 61 also after replacing the cleaning web 61 to the user often printing a large amount at a time. In this case, as illustrated in FIG. 11, it can be seen that the actual wind-up amount of the cleaning web 61 reaches "60 meters" (triangular mark in FIG. 11) regardless of that the LIFE value in accordance to Equation 1 is set to be "45%". Here, assume that an optimum timing for informing the replacement message to suppress the downtime of the image forming apparatus is assumed to be 55 meters (55% of LIFE value: square mark in FIG. 11) in view of the "actual moving amount per one winding operation of the cleaning web 61". If the replacement informing process is made in the same manner with the case before the initial replacement is made, the LIFE value is 40% at the moment when the wind-up amount is 55 meters, so that the replacement of the web cannot be informed. That is, because the replacement of the web is not informed when the wind-up amount is 55 meter even though the replacement of the web should be informed originally when the wind-up amount is 55 meters, the user may possibly use up the cleaning web 61 without making preparation for the replacement. Such situation may occur even when the LIFE equation is changed to Equation 2 reflecting the "actual moving amount per one winding operation of the cleaning web 61" based on the notch 69*a* defined at the position of 60 meters from the starting end of the cleaning web 61.

Then, after replacing the cleaning web 61, the LIFE equation finding the LIFE value of the "after detecting the notch" (see Equation 2) is used from beginning after the replacement of the cleaning web 61. This arrangement makes it possible to accurately grasp the wind-up amount of the cleaning web 61 and to suppress the cleaning web 61 from being used up without the user making the preparation for the replacement even for the user often printing a large amount at a time. It is also possible to suppress the cleaning web 61 from being replaced in a condition in which much cleaning web is left.

Figure 12:
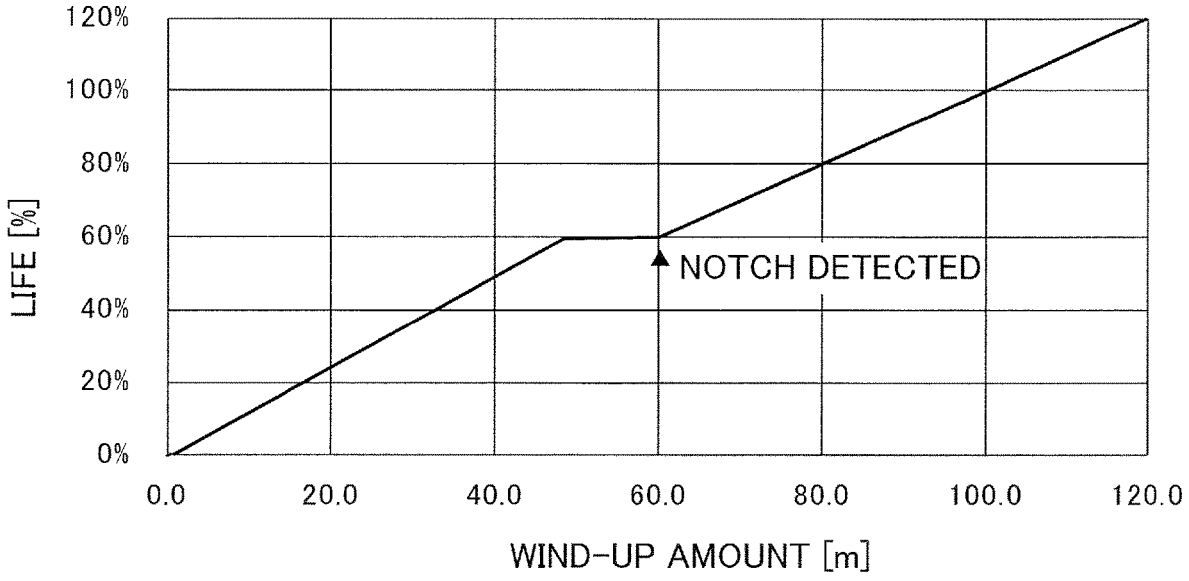
FIG. 12 is a graph illustrating a case where the LIFE value reaches a value corresponding to a predetermined position before detecting the notch.

Note that the first and second embodiments are arranged to be able to indicate the wind-up amount of the web, i.e., the usage, on the control panel 112 based on the LIFE value of the "before detecting the notch" found by Equation 1 (see Step S105 in FIGS. 7 and 10). In this case, the LIFE value is apt to be discontinuous between the "before detecting the notch" (in Step S104) and the "after detecting the notch" (in Step S107), and the user may possibly misunderstand the standard of the replacing timing of the cleaning web 61. That is, there is a case where the LIFE value exceeds the length from the starting end of the cleaning web 61 to the position where the notch 69*a* is provided, i.e., a length of "60%" of the whole length of the cleaning web 61 here (third usage), before detecting the notch 69*a* by the notch sensor 7. Then, the position of 60% where the notch 69*a* is provided is indicated as the wind-up amount of the web on the display portion 113 as illustrated in FIG. 12 until when the notch sensor 7 detects the notch 69*a*. This arrangement makes it possible to prevent the user from misunderstanding the approximate standard of the replacing timing of the cleaning web 61.

Note that the LIFE equation reflecting the "actual moving amount per one winding operation of the cleaning web 61" is not limited only to Equation 2 described above and may be also Equation 4 as described below.

LIFE value(%)=(actual moving amount per one winding operation of the cleaning web 61:see Equation 3)×(life-wise LIFE−LIFE in detecting the notch)/(web whole length−length until detecting the notch)×(actual web feed number of times−web feed number of times in detecting the notch)+LIFE in detecting the notch Eq. 4

The "life-wise LIFE" in Equation 4 is a LIFE in replacing the cleaning web and is "100%" for example in the case of the present embodiment. The "LIFE in detecting the notch" is "60%" for example in the case of the present embodiment. Still further, the "web whole length" is "100 meters" and the "length until detecting the notch" is "60 meters" as described above. It is noted the "actual web feed number of times" is a feed number of times from a new product condition of the cleaning web 61.

Figure 13:
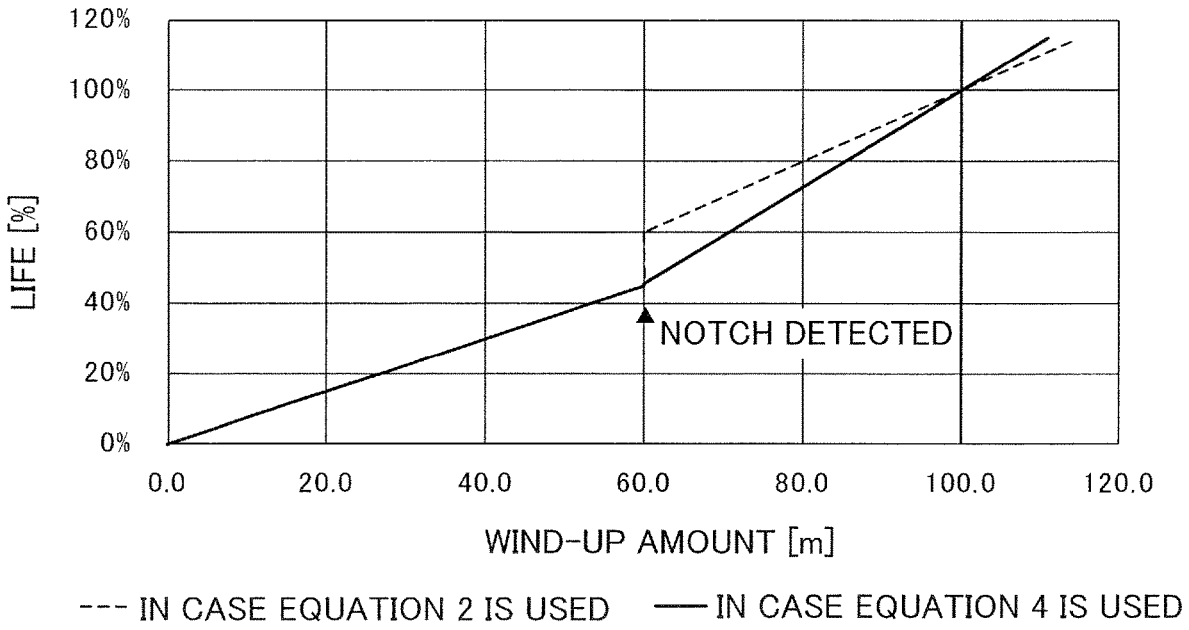
FIG. 13 is a graph illustrating a case where the LIFE value is continued before and after detecting the notch.

In this case, as illustrated in FIG. 13, the LIFE values hardly become discontinuous between the "before detecting the notch" (in Step S104) and the "after detecting the notch" (in Step S107) as compared to the case of using Equation 2 in indicating the wind-up amount of the web on the display portion 113 corresponding to the operation made by the user. Accordingly, the user can correctly grasp the approximate standard of the replacing timing of the cleaning web 61 before informing the replacement of the web regardless before or after detecting the notch.

By the way, there is a case where the user replaces the cleaning web 61 before detecting the notch in some cases. There is also a case where the user uses the cleaning web which has been partly used and wound up or the cleaning web 61 fully having a remaining amount of web without using a new cleaning web 61. In such a case, there is a possibility that the actual moving amount per one winding operation of the cleaning web 61 (see Equation 3) and also the LIFE value (see Equation 2) cannot be correctly found. For instance, in a case where the user uses the cleaning web 61 having a remaining amount, a web feed number of times until detecting the notch 69*a* within Equation 3 may be different from what a replacement is made with a new product. In a case where the user replaces the cleaning web 61 before detecting the notch, the web feed number of times may be different from the case where the user replaces the cleaning web 61 after detecting the notch. Therefore, it is unable to find the LIFE value correctly.

If the LIFE value cannot be correctly found as described above, there is a possibility that such processes as the indication of the web wind-up amount, i.e., the usage, based on the LIFE value (see Steps S105 and S108 in FIG. 7), the replacement of the web (see Step S110 in FIG. 7) and the image formation prohibited (see Step S112 in FIG. 7) cannot be adequately made. If so, the image forming job might be performed without informing the replacement of the web and the image formation prohibited regardless of that the web of the cleaning web 61 has been all wound up for example. If the image forming job is performed in the condition in which all of the web of the cleaning web 61 has been wound up, such situation may end up exchanging the fixing roller 40 or the pressure roller 41 on which soiled toner has accumulated or the collecting roller 62 being frictionally slide with the cleaning web 61 to which a large amount of toner is adhering. At this time, there is a possibility that the toner is transferred from the cleaning web 61 to the collecting roller 62 and is fixed on the image on the recording material P, thus soiling the image. Then, a third embodiment described below takes the abovementioned points into account.

Third Embodiment

The "replacement informing process" of a third embodiment will be described with reference to FIGS. 1 through 4 and by using FIG. 14. The "replacement informing process" of the third embodiment illustrated in FIG. 14 is different from the "replacement informing process" of the first embodiment illustrated in FIG. 7 in that processes of Steps S301 through S304 are added, so that their processes will be mainly described. The processes other than those processes are the same with the "replacement informing process" of the first embodiment, so that their description will be simplified by denoting the same reference numerals or will be omitted.

As illustrated in FIG. 14, after the process in Step S107, the control portion 110 determines whether the "actual moving amount per one winding operation of the cleaning web 61" (see Equation 3) obtained in the process in Step S107 is within a predetermined range in Step S301. If the "actual moving amount per one winding operation of the cleaning web 61" is within the predetermined range, i.e., Yes in Step S301, the control portion 110 advances to a process in Step S108 and executes the similar processes with the "replacement informing process" of the first embodiment described above in Steps S108 through S114. In the present embodiment, a case where "0.035 mm<actual moving amount per one winding operation of the cleaning web 61<0.0795 mm" for example will be referred to be "within the predetermined range". Note that this "within the predetermined range" is a wind-up range of the cleaning web 61 per one winding operation determined in advance based on numerical values when a new cleaning web 61 is used and is stored in the control portion 110.

Meanwhile, in a case where the "actual moving amount per one winding operation of the cleaning web 61" is not within the predetermined range, i.e., No in Step S301, the control portion 110 informs the user of "replacement of the cleaning web 61" in Step S302. As the replacement of the cleaning web 61 is informed, a replacement message urging the user of the replacement, saying "a remaining amount of the cleaning web 61 is becoming short and the cleaning web 61 needs to be replaced soon" for example is displayed on the display portion 113. Then, after detecting the notch, i.e., on and after when the notch sensor 7 detects the notch 69*a* (see Step S103), the control portion 110 determines whether the number of sheets of the recording materials on which images have been formed is more than a predetermined total number in Step S303. The control portion 110 repeats Step S303 until the number of sheets of the recording materials on which the images have been formed after detecting the notch becomes greater than the predetermined total number and waits, i.e., No in Step S303. During this time, the image forming job is continued and the control portion 110 counts the number of sheets of the recording materials on which the images have been formed after detecting the notch. In a case where the number of sheets of the recording materials on which the images have been formed after detecting the notch becomes greater than the predetermined total number, i.e., Yes in Step S303, the control portion 110 sets "image formation prohibited" of not permitting the execution of the image forming job in Step S304. In the case of the present embodiment, the control portion 110 prohibits the formation of the toner image to be transferred onto the recording materials P and finishes the image forming job being executed in the case where the number of sheets of the recording materials on which the images have been formed after detecting the notch becomes greater than the predetermined total number of sheets of "2,000" for example.

As described above, according to the present embodiment, the control portion 110 informs the user of the "replacement of the cleaning web 61" in the case where the "actual moving amount per one winding operation of the cleaning web 61" does not fall within the predetermined range. This arrangement makes it possible to urge the user to replace the cleaning web 61 before soiling the image even in a case where the user has replaced the cleaning web 61 before detecting the notch or where the user has used the cleaning web 61 having an enough remaining amount even through the web had been partially used. This arrangement also makes it possible to forcefully prohibit the formation of images after forming the images onto the predetermined total number of recording materials P corresponding to inform the replacement of the cleaning web 61. Thereby, there will be no possibility that the cleaning web 61 is continuously used in the condition of being used up even in a case where the correct LIFE value is not found because the user has replaced the cleaning web 61 before detecting the notch or where the user has used the cleaning web 61 having an enough remaining amount. Accordingly, it is possible to prevent the images from being soiled by the toner caused by the cleaning web 61.

Note that while the control portion 110 has determined whether to inform the user of the "replacement of the cleaning web 61" depending on whether the LIFE value of Equation 2 "after detecting the notch" is more than "95%" in the embodiments described above, the present disclosure is not limited to such case. The timing for informing the user of the "replacement of the cleaning web 61" may be different depending on an average image forming number of sheets per day of the user. For instance, the timing for informing the user of the replacement of the cleaning web 61 is set at "95%" of the LIFE value of Equation 2 for a user whose average image forming number of sheets per day is a first number of sheets. Meanwhile, for another user whose average image forming number of sheets per day is a second number of sheets which is greater than the first number of sheets, the timing for informing the user of the "replacement of the cleaning web 61" is set at "90%" of the LIFE value of Equation 2. This arrangement makes it possible to suppress a downtime of the image forming apparatus for waiting for the replacement of the cleaning web 61 because it is possible to inform the replacement of the web relatively sooner for the user whose average image forming number of sheets per day is large as compared to the user whose average image forming number of sheets per day is less. Still further, while the wind-up amount of the web has been indicated corresponding to the operation of the control panel 112 made by the user, the present disclosure is not limited to that (see Steps S105 and S108 in FIGS. 7, 10 and 14) and it is also possible to indicate a remaining number of days of the cleaning web 61. Here, the remaining number of days is a numerical value obtained by dividing the remaining amount of the cleaning web 61 (in meters) by "average image forming number of sheets per day of a user×actual moving amount per one winding operation (one sheet) of the cleaning web 61" (round down decimals). For instance, in a case where a LIFE value is 95%, a whole length of the cleaning web 61 is 100 meters, an average image forming number of sheets per day is 1,000 sheets and an actual moving amount per one winding operation (one sheet) is 0.5 mm, a remaining number of days is 10 days ((100−95) m/(1,000×0.5 mm)).

Note that while the cleaning unit 60 in which the fixing roller 40 frictionally slides with the collecting roller 62 without directly sliding with the cleaning web 61 has been described in the respective embodiments described above, the present disclosure is not limited to such case. For instance, the cleaning unit 60 may be what the fixing roller 40 directly and frictionally slides with the cleaning web 61.

Note also that while the cleaning unit 60 in which the fixing roller 40 or the pressure roller 41 is cleaned within the fixing unit 9 has been exemplified in the respective embodiments described above, the present disclosure is not limited to such case. The present disclosure is applicable also to the belt cleaning unit 22 cleaning the transfer residual toner left on the intermediate transfer belt 130 for example (see FIG. 1).

Note also that the case using the notch sensor 7 or 7A has been described in the respective embodiments described above, the present disclosure is not limited to such case. For instance, a marking may be indicated instead of the notch 69*a* or 69*b* on the cleaning web 61, and a sensor detecting the marking may be used.

Other Embodiments

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-165480, filed on Sep. 4, 2018, and No. 2019-079662, filed on Apr. 18, 2019, which is hereby incorporated by reference herein in its entirety.

What is claimed is:

1. An image forming apparatus, comprising:

a rotary member;

a web in contact with the rotary member to remove toner on the rotary member;

a moving unit replaceably supporting the web and configured to wind up the web to move a contact position of the web with the rotary member, the moving unit winding up the web every time when toner images are formed on a unit number of recording materials, if the toner images are formed on the recording materials each having a predetermined size;

a detecting unit configured to detect that the web has been wound up to a predetermined position; and a control portion configured to inform a replacement of the web, wherein the control portion informs, in a case where an actual moving amount per one winding operation is a first moving amount, the replacement of the web, if a number of sheets of recording materials on which images have been formed after the predetermined position is detected reaches a first number of sheets, the actual moving amount per one winding operation being defined as an average wind-up amount per unit number of sheets by which the moving unit has wound up the web to the predetermined position, and wherein the control portion informs, in a case where the actual moving amount per one winding operation is a second moving amount which is greater than the first moving amount, the replacement of the web, if a number of sheets of recording materials on which images have been formed after the predetermined position is detected reaches a second number of sheets which is less than the first number of sheets.

2. The image forming apparatus according to claim 1, wherein the control portion obtains the actual moving amount per one winding operation based on a number of times by which the web has been wound from a starting end to the predetermined position of the web and a length of the web from the starting end to the predetermined position of the web.

3. The image forming apparatus according to claim 1, wherein the control portion prohibits, in the case where the actual moving amount per one winding operation is the first moving amount, toner images from being formed on the recording materials, if a number of sheets of recording materials on which images have been formed after the replacement of the web is informed reaches a third number of sheets, and the control portion prohibits, in the case where the actual moving amount per one winding operation is the second moving amount, toner images from being formed on the recording materials, if a number of sheets of recording materials on which images have been formed after the replacement of the web is informed reaches a fourth number of sheets which is less than the third number of sheets.

4. The image forming apparatus according to claim 1, wherein the detecting unit is configured to detect that the web has been wound up to an upstream position upstream of the predetermined position in a moving direction of the web, and the control portion prohibits toner images from being formed on recording materials in a case where the detecting unit detects that the web has been wound up to the upstream position.

5. The image forming apparatus according to claim 1, wherein the control portion informs, in a case where a first replacement of the web has been carried out, a replacement of the web after the first replacement based on the actual moving amount per one winding operation obtained before the first replacement.

6. The image forming apparatus according to claim 1, further comprising a display portion indicating an usage of the web, wherein the control portion indicates a first usage obtained by a number of times by which the web has been wound up by the moving unit and a unit wind-up amount of the web per one winding operation set in advance until the predetermined position is detected, and indicates a second usage obtained by a number of times by which the web has been wound up and the actual moving amount per one winding operation after the predetermined position is detected, in indicating the usage of the web on the display portion.

7. The image forming apparatus according to claim 6, wherein if the first usage has become greater than a third usage corresponding to a length from a starting end to the predetermined position of the web before the predetermined position is detected, the control portion indicates the third usage on the display portion until the predetermined position is detected.

8. The image forming apparatus according to claim 1, wherein the control portion informs a replacement of the web in the case where the actual moving amount per one winding operation is not within a wind-up range of the web per one winding operation set in advance.

9. The image forming apparatus according to claim 1, wherein the control portion prohibits toner images from being formed on recording materials, if a number of sheets of recording materials on which images have been formed after the predetermined position is detected reaches a predetermined total number of sheets.

10. The image forming apparatus according to claim 1, wherein the web is provided with a notch at the predetermined position of the web, and the detecting unit is configured to detect the notch.

11. The image forming apparatus according to claim 1, further comprising a fixing member configured to heat and fix the toner image formed on the recording material, wherein the rotary member is a collecting member configured to collect the toner adhering to the fixing member by being driven by the fixing member.

12. The image forming apparatus according to claim 1, wherein the rotary member is a fixing member that heats and fixes the toner image formed on the recording material.

13. The image forming apparatus according to claim 1, wherein the rotary member is an image bearing member configured to rotate while bearing the toner image to be transferred onto the recording material.

14. An image forming apparatus, comprising:

a rotary member;

a web in contact with the rotary member to remove toner on the rotary member;

a display portion indicating a usage of the web;

a moving unit replaceably supporting the web and configured to wind up the web to move a contact position of the web with the rotary member, the moving unit winding up the web every time when toner images are formed on a unit number of recording materials, if the toner images are formed on the recording materials each having the recording materials of a predetermined size;

a detecting unit configured to detect that the web has been wound up to a predetermined position; and a control portion configured to indicate a usage of the web in the display portion, wherein the control portion indicates a first usage obtained by a number of times by which the web is wound by driving the moving unit and a unit wind-up amount of the web per one winding operation set in advance, until the predetermined position is detected, and wherein the control portion indicates a second usage obtained by a number of times by which the web has been wound and an actual moving amount per one winding operation after the predetermined position is detected, the actual moving amount per one winding operation being defined as an average wind-up amount per unit number of sheets by which the moving unit has wound up the web to the predetermined position.

15. An image forming apparatus, comprising:

a rotary member;

a web in contact with the rotary member to remove toner on the rotary member;

a moving unit replaceably supporting the web and configured to wind up the web to move a contact position of the web with the rotary member, the moving unit winding up the web every time when toner images are formed on a unit number of recording materials, if the toner images are formed on the recording materials each having a predetermined size;

a detecting unit configured to detect that the web has been wound up to a predetermined position; and a control portion configured to inform a replacement of the web if an actual moving amount per one wind-up amount defined as an average wind-up amount per unit number of sheets by which the moving unit has wound up the web to the predetermined position is not within a wind-up range of the web per one winding operation set in advance.

16. An image forming apparatus, comprising:

a rotary member;

a web in contact with the rotary member to remove toner on the rotary member;

a moving unit replaceably supporting the web and configured to wind up the web to move a contact position of the web with the rotary member;

a detecting unit configured to detect that the web has been wound up to a predetermined position;

a control portion to which a unit wind-up amount of the web per unit rotation amount of the rotary member is set and which is configured to move the web by the moving unit corresponding to a rotation amount of the rotary member; and a storage portion configured to store the rotation amount of the rotary member, wherein in response to a detection of the predetermined position by the detecting unit, the control portion obtains an actual moving amount of the web per unit rotation amount from a rotation amount, stored in the storage portion, of the rotary member until the predetermined position is detected and a length of the web to the predetermined position, and informs a replacement of the web based on the actual moving amount and a remaining length of the web.

* * * * *